US007891762B2

(12) United States Patent
Nakano et al.

(10) Patent No.: US 7,891,762 B2
(45) Date of Patent: Feb. 22, 2011

(54) DEVICE FOR FEEDING LIQUID TO INKJET HEADS AND DEVICE FOR WIPING INKJET HEADS

(75) Inventors: Teruyuki Nakano, Hiroshima (JP); Yasuhiro Kozawa, Hiroshima (JP)

(73) Assignee: Kabushiki Kaisha Ishiihyoki, Hiroshima (JP)

( * ) Notice: Subject to any disclaimer, the term of this patent is extended or adjusted under 35 U.S.C. 154(b) by 176 days.

(21) Appl. No.: 11/919,137

(22) PCT Filed: Jun. 8, 2005

(86) PCT No.: PCT/JP2005/010487

§ 371 (c)(1),
(2), (4) Date: Jan. 22, 2009

(87) PCT Pub. No.: WO2006/131965

PCT Pub. Date: Dec. 14, 2006

(65) Prior Publication Data

US 2009/0303283 A1 Dec. 10, 2009

(51) Int. Cl.
*B41J 2/165* (2006.01)

(52) U.S. Cl. ..... 347/33; 347/28; 347/32

(58) Field of Classification Search ..... 347/25, 347/28, 33, 32, 29

See application file for complete search history.

(56) References Cited

U.S. PATENT DOCUMENTS 4,411,706 A * 10/1983 Wallace et al. ..... 134/37
5,574,485 A * 11/1996 Anderson et al. ..... 347/27
5,594,477 A * 1/1997 Hilton ..... 347/30

FOREIGN PATENT DOCUMENTS

JP 05-017712 1/1993
JP 06-126972 5/1994

(Continued)

OTHER PUBLICATIONS

International Search Report mailed Sep. 20, 2005 for International Application No. PCT/JP2005/010487 of which the present application is the U.S. National Stage.

*Primary Examiner*—shih-wen hsieh
(74) *Attorney, Agent, or Firm*—Wenderoth, Lind & Ponack, L.L.P.

(57) ABSTRACT

When liquid materials are fed to inkjet heads, fluid pressures of liquid materials to be fed to inkjet heads are equalized so that a gas does not remain in liquid feed pipe lines without causing structures of the liquid feed pipe lines to be complicated. Separate liquid feed pipe lines (3) for feeding the liquid material, each of which communicates with each of a plurality of inkjet heads (4), are each connected to a common liquid feed pipe line (2) which stores one kind of the liquid material and communicates with an ink tank (1). Separate gas flow pipe lines (19), each of which is capable of feeding a gas and communicates with a connection portion between the common liquid feed pipe line (2) and each of the separate liquid feed pipe lines (3), with each of the inkjet heads (4), or with both the connection portion and each of the inkjet heads (4), are each connected to a bypass pipe line (18*a*) (common gas flow pipe line (18)) capable of being opened and closed with respect to the atmosphere.

9 Claims, 9 Drawing Sheets

FOREIGN PATENT DOCUMENTS

| | | |
|---|---|---|
| JP | 08-118668 | 5/1996 |
| JP | 08-197742 | 8/1996 |
| JP | 10-298470 | 11/1998 |
| JP | 11-028307 | 2/1999 |
| JP | 11-209670 | 8/1999 |
| JP | 2000-190514 | 7/2000 |
| JP | 2002-240310 | 8/2002 |
| JP | 2002-307708 | 10/2002 |
| JP | 2003-088778 | 3/2003 |
| JP | 2003-182088 | 7/2003 |
| JP | 2003-275659 | 9/2003 |
| JP | 2003-341083 | 12/2003 |
| JP | 2004-174845 | 6/2004 |
| JP | 2005-169730 | 6/2005 |
| JP | 2005-169928 | 6/2005 |
| JP | 2005-193618 | 7/2005 |

* cited by examiner

DEVICE FOR FEEDING LIQUID TO INKJET HEADS AND DEVICE FOR WIPING INKJET HEADS

TECHNICAL FIELD

The present invention relates to a liquid feeding device for inkjet heads which is structured such that a liquid material is fed to inkjet heads from an ink tank, and to an inkjet head wiping device which is used to appropriately wipe and remove a foreign matter attached to a liquid material ejection port of each of inkjet heads and the vicinity thereof.

BACKGROUND ART

In recent years, a so-called inkjet method using an inkjet head has been widely employed in printing using ink on a print medium such as paper, in forming an orientation film or applying UV ink onto a substrate (transparent substrate) of a liquid crystal display device or the like, or in applying a color filter onto a substrate of an organic EL display device.

An inkjet printer (hereinafter including an oriented film forming device and a coating device) employing the inkjet method is provided with a liquid feeding device for feeding a liquid material from an ink tank to inkjet heads (specifically, liquid pool provided in each of inkjet heads). In this case, a large inkjet printer generally includes a plurality of inkjet heads. Accordingly, it is necessary to provide a plurality of liquid feed pipe lines for feeding the liquid material to the plurality of inkjet heads from the ink tank.

The liquid feeding device for inkjet heads of this type has a structure, for example, as illustrated in FIG. 12, in which inkjet heads 52 are each connected to a downstream end of each of a plurality of liquid feed pipe lines 51, which directly communicate with an ink tank 50, and a liquid feed pump 53 for pressure-feeding the liquid material from the ink tank 50 to each of the inkjet heads 52 is provided halfway on each of the liquid feed pipe lines 51. With this structure, the necessary number of liquid feed pipe lines 51, each of which directly communicates with the ink tank 50 and with each of the inkjet heads 52, corresponds to the number of the inkjet heads 52 to be provided, and the necessary number of the liquid feed pumps 53 also corresponds to the number of the inkjet heads 52 to be provided. As a result, the liquid feeding device is increased in size, a structure thereof is complicated, and costs thereof are increased.

As another example, as illustrated in FIG. 13, there is generally known a liquid feeding device having a structure in which inkjet heads 62 are each connected to a downstream end of each of a plurality of liquid feed pipe lines 61, which directly communicate with an ink tank 60, and a pressure source 63 for pressurizing the interior of the ink tank 60 is provided in place of the liquid feed pump. Also with this structure, the necessary number of the liquid feed pipe lines 61, each of which directly communicates with the ink tank 60 and with each of the inkjet heads 62, corresponds to the number of the inkjet heads 62 to be provided, with the result that the size of the liquid feeding device is increased and the costs thereof are increased. In addition, the liquid material is fed with a uniform pressure with respect to each of the inkjet heads 62, so it is necessary to set lengths of the plurality of liquid feed pipe lines 61 to be equal to each other, which also increases the size of the liquid feeding device and raises the costs.

As an example of a liquid feeding device which is devised so as to avoid those fundamental problems, Patent Documents 1 and 2 below disclose a structure in which a main pipe line which communicates with an ink tank, and a plurality of branch pipe lines, each of which is branched from the main pipe line, are provided, and inkjet heads are each connected to the downstream end of each of the branch pipe lines. Specifically, Patent Document 1 discloses a structure in which a pipe line communicating with a main tank is branched into a plurality of pipe lines, and the inkjet heads are connected to each of the branch pipe lines through a sub tank. Further, Patent Document 2 discloses a structure in which the main pipe line communicating with a solution tank is branched into a plurality of pipe lines, and the adjacent inkjet heads each connected to the downstream end of each of the branch pipe lines are brought into close contact with each other.

Further, as described above, the inkjet head of this type is provided with a liquid feed path for feeding the liquid material from the ink tank to the inkjet head (specifically, liquid pool provided in the inkjet head). In this case, when an amount of a dissolved gas contained in the liquid material to be fed to the inkjet head through the liquid feed path is equal to or larger than an allowable value (for example, 4 ml/1000 ml), air bubbles are generated in the liquid pool of the inkjet head. For this reason, when the liquid material is ejected from the liquid pool through the ejection nozzle, the appropriate ejection of the liquid material is inhibited while the air bubbles act as cushions.

Halfway on the liquid feed path of the inkjet head, there is provided a deaerating unit for reducing the amount of the dissolved gas contained in the liquid material to be smaller than the allowable value. In this case, for the conventional deaerating unit, there is used a hollow fiber membrane obtained by collecting into a bundle a plurality of hollow fibers, each of which is made of a gas-permeable film such as polytetrafluoroethylene (for example, see Patent Documents 3 to 5 below).

Specifically, the deaerating unit has a structure in which the above-mentioned hollow fibers are provided halfway on the liquid feed pipe for feeding the liquid material from the ink tank to the inkjet head, an outer peripheral side of the hollow fiber membrane is covered with a container which is an enclosure, and the interior of the container is depressurized to obtain a vacuum state, thereby removing the dissolved gas or the air bubbles from the liquid material passing through the hollow fiber membrane to deaerate the liquid material.

In this case, each unit hollow fiber of the hollow fiber membrane has generally an inner diameter of about 20 to 30 μm (in Patent Document 4, inner diameter of 50 to 500 μm). The diameter of the entire hollow fiber membrane is much larger than the diameter of each of the liquid feed pipe lines to be connected to an upstream side and to a downstream side thereof. The container for the deaerating unit covers not only the outer peripheral surface of the hollow fiber membrane but also an upstream side end surface and a downstream side end surface thereof. Accordingly, the entire periphery (entire length) of the hollow fiber membrane is completely covered with the container.

Further, the inkjet head of this type has a liquid material ejection port opened therein for ejecting an ink or a film material onto one end surface, and the ink is ejected and supplied to a print medium such as paper from the liquid material ejection port, or a liquid film material is ejected and supplied to a transparent substrate of a display device or the like.

In the inkjet head of this type, the ink or the film material is ejected from the liquid material ejection port having an extremely small opening area. As a result, the liquid material itself or a pigment, for example, contained in the liquid material is solidified, for example, and attaches to the liquid material ejection port and the vicinity thereof. In addition, foreign matters such as dust contained in the outside air are also attached to the liquid material ejection port and the vicinity thereof. This causes an ejection failure of the liquid material, and inhibits the printing on the print medium and formation of the oriented film.

Therefore, in the inkjet head of this type, for the purpose of recovering a liquid material ejection function of the inkjet head to an excellent state at appropriate time intervals before causing those problems, the cleaning mobile unit for cleaning the liquid material ejection port and/or the vicinity thereof is provided. As the cleaning mobile unit, there is known one including negative pressure suction means for sucking and removing a solidified material and foreign matters attached the liquid material ejection port and/or the vicinity thereof, by a suction force due to a negative pressure.

As an example of the cleaning mobile unit, Patent Document 6 described below discloses a technology for directly bringing a vacuum hood of the cleaning mobile unit into contact with the one end surface in which material ejection ports of the inkjet head (print head) are opened, to perform negative pressure suction through the vacuum hood with respect to not only the material ejection port but also the inside thereof. Patent Documents 7 and 8 described below disclose a structure in which a vacuum nozzle is provided to the cleaning mobile unit, and the vacuum nozzle itself is not brought into contact with the one end surface in which the material ejection ports of the inkjet head are opened.

[Patent Document 1] JP 2002-307708 A
[Patent Document 2] JP 2003-88778 A
[Patent Document 3] JP 5-17712 A
[Patent Document 4] JP 10-298470 A
[Patent Document 5] JP 11-209670 A
[Patent Document 6] JP 2000-190514 A
[Patent Document 7] JP 6-126972 A
[Patent Document 8] JP 8-118668 A

DISCLOSURE OF THE INVENTION

Problem to be Solved by the Invention

The liquid feeding device for inkjet heads disclosed in Patent Documents 1 and 2 merely include the main pipe line and the branch pipe lines for feeding the liquid material, which lead from the ink tank to the respective inkjet heads. In other words, the liquid feeding device for inkjet heads merely include the liquid feed pipe lines for circulating a liquid. Accordingly, there are such defects that even when the gas such as air exists in those liquid feed pipe lines, the gas cannot be actively released to the outside, which is problematic because the gas may remain in the liquid feed pipe lines, and if the gas remains in the liquid feed pipe lines, the ejection of the liquid material from the inkjet head is inhibited.

Further, it is difficult for the liquid feeding device for inkjet heads disclosed in Patent Documents 1 and 2 to equalize the fluid pressures of the liquid materials to be separately fed to the inkjet heads from the ink tank through each of the branch pipe lines. The problem may arise due to, for example, a difference in length of the liquid feed pipe lines for the liquid material among the inkjet heads. However, Patent Documents 1 and 2 do not take any countermeasures for equalizing the fluid pressures of the inkjet heads, and do not even disclose or suggest awareness of the problem, and the fact is that it is desired to take appropriate measures.

Accordingly, it is a first technical object of the present invention to prevent a gas from remaining in the liquid pipe lines without complicating the structures of the pipe lines, and to equalize the fluid pressures of the liquid materials to be fed to each of the inkjet heads, when the liquid material is fed to a plurality of inkjet heads.

As disclosed in Patent Documents 3 to 5, when the hollow fiber membrane is used to deaerate the liquid material to be fed to the inkjet heads, the diameter of the hollow fiber membrane is much larger than the diameter of the liquid feed pipe, and the diameter of each unit hollow fiber is much smaller than the diameter of the liquid feed pipe, as described above. Accordingly, when the liquid material flows into the deaerating unit having the hollow fiber membrane, from the liquid feed pipe, a stirring flow, turbulence, or the like is generated in a portion at which the flow of the liquid material is stagnant, with the result that air bubbles are generated. Further, there are such defects that the air bubbles remain in the portion where the air bubbles are generated, which increases the amount of the dissolved gas contained in the liquid material, and which may lead to inhibition of the ejection of the liquid material from the inkjet head.

In the method using the hollow fiber membrane, flow resistance of each unit hollow fiber and flow resistance of the entire hollow fiber membrane become large, so it is necessary to feed the liquid material at high pressure. For this reason, it is necessary to produce the liquid flow path with high strength, which increases manufacturing costs, and in addition, which easily damages the liquid material path, increases pressure drop, and is wasteful. Accordingly, the method can be applied to a liquid material having a low viscosity (for example, liquid material having a viscosity of 5 cp or less), but the use of a liquid material having a high viscosity (for example, liquid material having a viscosity of 5 cp or more or 6 cp or more) may cause a fatal problem such as inhibition of liquid feeding.

Further, when the hollow fiber membrane is disposed on the liquid feed path, it becomes difficult to perform cleaning of the liquid feed path due to the existence of the hollow fiber membrane. As a result, even after the liquid feed path is cleaned, the liquid material, foreign matters, or solidified materials thereof are attached to an internal path or the like of each unit hollow fiber of the hollow fiber membrane. This inhibits the subsequent ejection of the liquid material. Therefore, there is a fear that this also inhibits the ejection of the liquid material from the inkjet head.

In addition, when the deaerating unit is mounted to the liquid feed path, it is necessary to cover the entire periphery (entire length) of the hollow fiber membrane by the enclosure. Accordingly, the deaerating unit has to be disposed at a position where the hollow fiber membrane exists, and the position for disposing the deaerating unit is unambiguously determined, which causes a problem of limiting the degree of freedom of layout.

Accordingly, it is a second technical object of the present invention to reduce generation of air bubbles caused when the liquid material flows into the deaerating unit as much as possible to suppress the increase of the amount of dissolved gas, and to make it possible to deaerate the liquid material while feeding the liquid material smoothly even at low pressure, thereby ensuring and facilitating the cleaning operation, and increasing the degree of freedom of layout of the deaerating unit.

On the other hand, in the technique disclosed in Patent Document 6 above, the vacuum hood of the cleaning mobile unit is brought into contact with the inkjet head, which causes the contact portion to be damaged. Accordingly, it becomes difficult to use the cleaning mobile unit for a long period of time, which leads to reduction in durability. In addition, foreign matters such as wear dust or abraded dust are generated due to the contact therebetween, and the foreign matters are attached to the liquid ejection port of the inkjet head or the vicinity thereof. As a result, the liquid material ejection failure is caused, which inhibits the printing, the oriented film formation, and the negative pressure suction.

Further, in the technique disclosed in Patent Document 7 above, the vacuum nozzle remains not to be in contact with the inkjet head, but a support member for supporting the vacuum nozzle is pressed and urged against the inkjet head side by a spring, and is brought into contact with a ledge surface of the inkjet head. Accordingly, even in this technology, the support member of the cleaning mobile unit is brought into contact with the inkjet head, so there arises problems of reduction in durability and generation of foreign matters such as wear dust due to generation of flaws at the contact portion, an ejection failure of the liquid material, a printing failure or an oriented film formation failure, a negative pressure suction failure, and the like due to the generation of the above.

Further, in the technology disclosed in Patent Document 8 above, the vacuum nozzle provided to the cleaning mobile unit is maintained not to be in contact with the inkjet head, but a cleaning nozzle of an ultrasonic liquid wiper device provided to the cleaning mobile unit is in contact with the nozzle surface of the inkjet head through the intermediation of liquid columns (menisci in Patent Document 8) of the cleaning fluid which are formed at the leading end of the cleaning nozzle, and excitation with an applied voltage is transferred to the nozzle surface of the inkjet head through the liquid columns. In this structure, it is necessary to form appropriate liquid columns between the cleaning nozzle and the inkjet head, so the positional relationship therebetween has to be strictly determined, and positioning thereof has to be performed with extremely high precision. For this reason, the structure is complicated and it becomes necessary to perform assembly of the components with high accuracy, which makes the assembly operation cumbersome and complicated, and in addition, which is disadvantageous in terms of costs as well.

In addition, with the method using the cleaning fluid as described above, the cleaning fluid enters the inkjet head through the liquid material ejection ports of the inkjet head, and the cleaning fluid is mixed into the liquid material. As a result, the concentration of the liquid material is lowered, which greatly inhibits normal printing and oriented film formation.

Accordingly, it is a third technical object of the present invention to prevent the positional relationship between the cleaning mobile unit and the inkjet head from being extremely strictly limited, to thereby avoid the reduction in durability due to contact therebetween, the generation of foreign matters such as wear dust, the printing failure or the oriented film formation failure, the negative pressure suction failure, and the like. Further, it is a fourth technical object of the present invention to avoid the problem of reducing the concentration of the liquid material, which is caused when the cleaning fluid enters the inkjet head through the liquid material ejection ports of the inkjet head to be mixed into the liquid material, during the use of the wiping device, to thereby increase the cleaning ability by the negative pressure suction.

Means for Solving the Problems

In order to attain the above-mentioned first technical object, according to the present invention, there is provided a liquid feeding device for inkjet heads, for feeding a liquid material to a plurality of inkjet heads from an ink tank, including: separate liquid feed pipe lines for feeding the liquid material, each of which communicates with each of the plurality of inkjet heads; a common liquid feed pipe line for storing one kind of the liquid material and communicates with one ink tank, the common liquid feed pipe line being connected to each of the separate liquid feed pipe lines; separate gas flow pipe lines capable of flowing a gas, each of which is connected to a connection portion between the common liquid feed pipe line and each of the separate liquid feed pipe lines, to each of the plurality of inkjet heads, or to both the connection portion and each of the plurality of inkjet heads; and a common gas flow pipe line capable of being opened and closed with respect to an atmosphere, the common gas flow pipe line being connected to each of the separate gas flow pipe lines. Here, the "inkjet head" described above specifically refers to a liquid pool which communicates with an ejection nozzle (for example, a plurality of ejection nozzles) inside the inkjet head.

With this structure, the liquid material stored in the one ink tank is fed to each of the inkjet heads through each of the separate liquid feed pipe lines from the common liquid feed pipe line. In the process of feeding the liquid material, if a gas such as air exists in the common liquid feed pipe line, the gas can be released to the atmosphere from each of the separate gas flow pipe lines through the common gas flow pipe line. Specifically, at an initial stage where the liquid material is started to flow from the ink tank to the common liquid feed pipe line, a gas exists in the common liquid feed pipe line in many cases, and the gas may flow into each of the separate liquid feed pipe lines together with the liquid material, and further flow into each of the inkjet heads. However, the separate gas flow pipe lines are each connected to each of the connection portions between the common liquid feed pipe line and each of the separate liquid feed pipe lines, each of the inkjet heads, or the each portion therebetween. The separate gas flow pipe lines are each connected to the common gas flow pipe line capable of opening and closing with respect to the atmosphere. Accordingly, when the common gas flow pipe line is opened to the atmosphere during a period in which the liquid material can flow into the inkjet heads from the common liquid feed pipe line through each of the separate liquid feed pipe lines, the gas can be released to the atmosphere from each of the separate gas flow pipe lines through the common gas flow pipe line. As a result, the situation where the liquid material is stored together with the gas in the common gas flow liquid pipe line and each of the inkjet heads can be avoided, thereby making it possible to effectively prevent inhibition of the ejection of the liquid material from the inkjet heads due to existence of the gas.

In addition, while the liquid material flows from the common liquid feed pipe line through each of the separate liquid feed pipe lines to be stored in each of the inkjet heads, the gas is rapidly released from the common gas flow pipe line through each of the separate gas flow pipe lines, thereby effectively preventing an adverse effect of the gas on the liquid material stored in each of the inkjet heads. As a result, the liquid materials stored in each of the inkjet heads each have a uniform pressure after the liquid materials flow thereinto, and variation in ejection of the liquid material from each of the inkjet heads is not caused, and ejection of the liquid material from each of the inkjet heads is possible in a state where excellent responsiveness is secured.

Further, the separate liquid feed pipe lines are each connected to the common liquid feed pipe line which leads to one ink tank, and the separate gas flow pipe lines are each connected to the common gas flow pipe line which can be opened to the atmosphere. As a result, all the pipe lines through which the liquid material and the gas flow can be simplified. In addition, the number of control means constituted by valve means and the like, for controlling starting and stopping of feeding of the liquid material from the ink tank to each of the inkjet heads, can be reduced, and the number of control means constituted by valve means for releasing and enclosing the gas with respect to the atmosphere can also be reduced, thereby making it possible to simplify the structure of the liquid feeding device and reduce manufacturing costs.

In this case, it is preferable that the gas be released to the common gas flow pipe line from the connection portion between the common liquid feed pipe line and the separate gas flow pipe line provided on the lowermost stream side, or from the vicinity thereof.

Thus, the gas flowing through the common liquid feed pipe line is reliably released to the common gas flow pipe line to be released into the atmosphere. As a result, a malfunction due to the gas remaining in the common liquid feed pipe line or flowing from the common liquid feed pipe line into each of the inkjet heads hardly occurs.

In the case where each of the separate gas flow pipe lines is connected to the connection portion between the common liquid feed pipe line and each of the liquid feed pipe lines, the gas, which is fed from the ink tank through the common liquid feed pipe line together with the liquid material, is to be released to the atmosphere from the connection portions between each of the separate liquid feed pipe lines and the common liquid feed pipe line through each of the separate gas flow pipe lines and the common gas flow pipe line, immediately before the gas enters each of the separate liquid feed pipe lines. Note that the gas already remaining in each of the inkjet heads is to be released into the atmosphere from ejection nozzles of the inkjet heads.

In the case where the separate gas flow pipe lines are connected to the inkjet heads, the gas flowing into the inkjet heads and the gas remaining in the inkjet heads are to be released into the atmosphere through each of the separate gas flow pipe lines connected to each of the inkjet heads, and through the common gas flow pipe line.

Further, in a case where the separate gas flow pipe lines are each connected between each of the connection portions and each of the inkjet heads, that is, at a halfway position of each of the separate liquid separating pipe lines between the connection portions and each of the inkjet heads, the gas fed from the ink tank and passing through the common liquid feed pipe line together with the liquid material is to be released into the atmosphere through each of the separate gas flow pipe lines and the common gas flow pipe line even after the gas flows into each of the separate liquid feed pipe lines. Note that, also in this case, the gas already remaining in the inkjet heads is to be released into the atmosphere from the ejection nozzles of the inkjet heads.

In the above-mentioned structure, it is preferable to connect the common gas flow pipe line to a negative pressure pipe line which leads to a negative pressure source.

Thus, after the liquid material is flown into each of the inkjet heads, the common gas flow pipe line is closed with respect to the atmosphere, and then the negative pressure from the negative source is caused to act on the common gas flow pipe line, each of the separate gas flow pipe lines, and each of the inkjet heads leading to the common gas flow pipe line. As a result, the internal pressure of the liquid material of each of the inkjet heads is reduced, so-called liquid drop from a leading edge of the ejection nozzle is effectively prevented, and the internal pressure can be uniformly reduced among the inkjet heads, thereby making it possible to preferably eject the liquid material without causing variation.

In this case, it is preferable that the common gas flow pipe line include a bypass pipe line leading to the negative pressure pipe line, and the separate gas flow pipe lines be connected at predetermined intervals.

Thus, the negative pressure from the negative pressure pipe line acts on the separate gas flow pipe lines arranged at the predetermined intervals through the bypass pipe line, thereby making it possible to apply the negative pressure to the liquid material contained in the inkjet heads with excellent responsiveness, uniformity, and stability.

In the above-mentioned structure, it is preferable to employ a structure in which a pressure gas from a gas pressure source is pressure-fed into the internal space of the ink tank.

With the structure, when the pressure air from the pressure gas source is flown into the internal space of the ink tank, the liquid material stored in the ink tank is swept into the common liquid feed pipe line by the pressure air, and is filled in each of the inkjet heads through each of the separate liquid feed pipe lines. As a result, the liquid material can be fed to each of the inkjet heads with uniform pressure, and the liquid material is filled in each of the inkjet heads from the ink tank in an extremely short time period, which leads to swiftness of the filling operation and improvement of the operation efficiency.

In the above-mentioned structure, it is preferable that the common gas flow pipe line extend in the horizontal direction above the liquid surface of the ink tank, each of the separate gas flow pipe lines extend downward from the common liquid feed pipe line, the common liquid feed pipe line extend in the horizontal direction at a position below the common gas flow pipe line and above the inkjet heads, and each of the separate liquid feed pipe lines extend downward from the common liquid feed pipe line.

With this structure, even when a pump or the like for releasing the gas into the atmosphere is not provided, the gas can be released into the atmosphere from the common liquid feed pipe line and the inkjet heads with reliability and efficiency, owing to a natural phenomenon in which the gas comes upward in the liquid material.

Further, in order to attain the above-mentioned second technical object of the present invention, there is provided a liquid feeding device for inkjet heads, including: a liquid feed path for feeding a liquid material from an ink tank to inkjet heads; an enclosure provided halfway on the liquid feed path so as to cover an outer surface side of the liquid feed path; and a deaerating unit for depressurizing an interior of the enclosure to perform deaeration of the liquid material, in which: the liquid feed path comprises a deaerating tube which has gas permeability, has a single internal flow path, and is made of a synthetic resin; and the enclosure of the deaerating unit covers a part of the deaerating tube in a liquid feeding direction.

With the structure, only a part of the deaerating tube, which has gas permeability and is made of a synthetic resin, is covered in the liquid feeding direction by the enclosure of the deaerating unit. The entire periphery (entire length) of the deaerating tube is not covered with the enclosure. In addition, the internal flow path of the deaerating tube is a single path, so when the liquid material flows into the deaerating unit through the deaerating tube, the liquid material merely flows along the internal flow path of the deaerating tube. Accordingly, when the liquid material flows into the deaerating unit, a stirring flow, turbulence, or the like is not generated due to the stagnation of the flow of the liquid material. Thus, there does not occur a situation in which air bubbles are generated in the liquid material provided in the deaerating tube and the amount of dissolved gas is increased. As a result, it is possible to prevent, as much as possible, the problem in that the liquid material is not smoothly ejected from the ejection nozzle of the inkjet head due to the air bubbles.

It is unnecessary to set the inner diameter of the above-mentioned deaerating tube to be small as that of each unit hollow finer of the conventional hollow fiber membrane. For this reason, it is possible to reduce the flow resistance and smoothly feed the liquid material even at low pressure. As a result, even when the liquid feed path does not have relatively high strength, the liquid feed path can be sufficiently used, the manufacturing costs can be reduced, the liquid feed path is hardly damaged, and the pressure drop is decreased, thereby reducing wastes as much as possible. As a result, the use of the liquid material having high viscosity enables deaeration while maintaining smooth liquid feeding.

Further, a contact area between an inner surface of the flow path of the deaerating tube and the liquid material is reduced to a large extent as compared with a total contact area between an inner surface of the flow path of the conventional hollow finer membrane and the liquid material. In addition, the internal flow path of the deaerating tube is smoothly formed in a continuous manner. Accordingly, the inner surface of the deaerating tube is hardly contaminated, and the cleaning fluid smoothly flows during the cleaning operation. As a result, the cleaning of the deaerating unit can be performed with ease and reliability, and there hardly arises the problem in that the liquid material, foreign matters, or solidified materials thereof are attached to the internal flow path or the like, which inhibits the feeding of the liquid material.

In addition, when the deaerating unit is mounted to the liquid feed path, there is no need to cover the entire length of the deaerating tube, and it is sufficient that a desired part of the deaerating tube is covered with the enclosure. As a result, it is possible to avoid the problem in that the position for disposing the deaerating unit is unambiguously determined, thereby increasing the degree of freedom of layout in the case of disposing the deaerating unit.

In the above-mentioned structure, it is desirable that one or a plurality of deaerating units be arranged in series with respect to one deaerating tube.

In other words, it is possible to dispose one deaerating unit or a plurality of deaerating units in series to a portion of a bundle of two or three deaerating tubes, in the liquid feeding direction. As long as the deaerating unit is disposed with respect to one deaerating tube, the deaerating unit can be reduced in size, the liquid feed path can be made compact, the manufacturing costs can be reduced, and it becomes unnecessary to form a merging portion and a branch portion of the deaerating tube. As a result, the stirring flow or turbulence of the liquid material hardly occurs, and the excessive increase of the dissolved gas can be suppressed. The actions and effects become more remarkable than those of the case of using the hollow fiber membrane as in the related art.

In the above-mentioned structure, it is desirable that at least a downstream side portion of the liquid feed path for feeding one kind of the liquid material to one inkjet head be formed of one deaerating tube.

With the structure, the number of deaerating tubes can be reduced to the requisite minimum, the structure of the liquid feed path can be simplified, and the manufacturing costs can be reduced. In addition, when the deaerating unit is disposed to the deaerating tube at the downstream side portion, the dissolved gas, which is mixed into the liquid material from the outside through a peripheral wall of the deaerating tube after the deaeration, is less carried by the inkjet head (liquid pool provided inside thereof), thereby making it possible to avoid the adverse effect of the air bubbles during the ejection of the liquid material as much as possible. In this case, it is preferable to integrate the inkjet head and the deaerating unit with each other.

In the above-mentioned structure, it is desirable that the deaerating tube have an inner diameter in a range from 1.0 to 4.0 mm and an outer diameter in a range from 1.2 to 5.0 mm. Note that the inner diameter and the outer diameter thereof are set within the respective above-mentioned ranges, and the outer diameter is set to be larger than the inner diameter as a matter of course. The deaerating tube preferably has a wall thickness of 0.1 to 0.5 mm, and specifically about 0.2 mm.

In other words, when the inner diameter of the deaerating tube is smaller than 1.0 mm, the flow path resistance of the flow path is increased, with the result that a large pressure drop occurs, and the liquid material cannot be fed at low pressure. When the inner diameter of the deaerating tube exceeds 4.0 mm, it becomes difficult to finely adjust the liquid feed amount or liquid feed pressure of the liquid material with respect to the inkjet head without causing a time delay. For this reason, when the inner diameter of the deaerating tube is set in the above-mentioned numerical value range, those problems hardly arise. On the other hand, when the outer diameter of the deaerating tube is smaller than 1.2 mm, the inner diameter of the deaerating tube inevitably becomes small. For this reason, there arises the problem of the increase in flow path resistance or the like. In addition, there is such a defect that, when the deaerating tube is bent, the deaerating tube is folded, which inhibits the flow of the liquid material. Further, when the outer diameter of the deaerating tube exceeds 5.0 mm, the liquid feed path is increased in size, and there arise problems in terms of a space for disposing the deaerating tube and layout thereof. Accordingly, when the outer diameter of the deaerating tube is set within the above-mentioned numerical value range, those problems do not arise.

In the above-mentioned structure, it is desirable that the deaerating tube be deformed to be accommodated in the enclosure so that a length of the deaerating tube at a portion covered with the enclosure of the deaerating unit is 1.5 times that of the enclosure in a liquid feeding direction.

With the structure, the length of the deaerating tube, which is accommodated in the enclosure and is affected by the deaeration operation due to decompression, becomes 1.5 times or more that of a deaerating tube which is accommodated in the enclosure so as to linearly extend therein. Accordingly, even when the length of the deaerating unit is not long in the liquid feeding direction, the deaeration can be sufficiently and reliably performed, which enhances a deaeration efficiency to a large extent. In view of the above, the amplification of the length of the deaerating tube is preferably two or more, or three or more orders. The length of the deaerating tube, which is accommodated in the enclosure and is affected by the deaeration operation due to decompression, is preferably 200 to 800 mm or 300 to 700 mm, and specifically 500 mm. The length of the enclosure in the liquid feeding direction is preferably about 50 to 200 mm.

With the above-mentioned structure, the liquid material preferably has a viscosity of 5 to 18 cp. An example of the material having the viscosity includes a film material (for example, oriented film material) used in a case of forming a film (for example, oriented film) on a substrate (for example, transparent substrate of liquid crystal display device).

In this case, for example, the viscosity of the liquid material (ink) used for a typical inkjet printer for printing is about 2.5 cp. Accordingly, it cannot be said that, even when the liquid material has a tube structure in which the flow path resistance and the pressure drop are increased as in the conventional hollow fiber membrane, the liquid material cannot be completely used. However, when the viscosity thereof is 5 to 18 cp, the increase of the flow path resistance and the pressure drop causes a fatal problem in the conventional hollow fiber membrane. On the other hand, in the deaerating tube and the deaerating unit according to the present invention, which have the above-mentioned structures, the flow path resistance and the pressure drop are small. Accordingly, even if the liquid material having high viscosity is used, liquid feeding can be smoothly performed and there arises almost no problem. Note that a surface tension of the liquid material which can be smoothly fed in the liquid feeding device according to the present invention and which has high viscosity, for example, the oriented film material, is 30 to 40 dyn/cm.

In addition, the application of the liquid feeding device according to the present invention to a large printer having a plurality of inkjet heads, particularly contributes to compactness, and makes it possible to easily perform a maintenance work.

Further, in order to attain the above-mentioned third technical object of the present invention, there is provided an inkjet head wiping device, for cleaning a liquid material ejection port of an inkjet head and/or a vicinity thereof, including: a cleaning mobile unit which includes a vacuum nozzle for generating a negative pressure in the liquid material ejection port and/or the vicinity thereof, and which is relatively movable with respect to the inkjet head, in which all the components of the cleaning mobile unit are completely separated from the inkjet head to be maintained in a contactless manner.

In this case, "all the components" of the cleaning mobile unit includes not only components of the cleaning mobile unit but also the liquid columns of the cleaning fluid. Accordingly, a situation in which all the components of the cleaning mobile unit are completely separated from the inkjet head to be maintained in a contactless state excludes a case where some of the components of the cleaning mobile unit are in contact with the inkjet head, and also excludes a case where the cleaning mobile unit and the inkjet head are in contact with each other through the intermediation of, for example, the liquid columns of the cleaning fluid.

With the structure, since the components of the cleaning mobile unit are not brought into contact with the inkjet head, problems such as the generation of flaws due to the contact therebetween, and the deterioration in durability due to the generation of the flaws do not arise. In addition, the following problems do not arise. That is, the attachment of foreign matters such as wear dust to the liquid material ejection port of the inkjet head and to the vicinity thereof, the ejection failure of the liquid material and the printing failure or the oriented film formation failure due to the attachment of the foreign matters, the negative pressure suction failure, and the like. In addition, there occurs no situation in which the cleaning mobile unit and the inkjet head are brought into contact with each other through the intermediation of the liquid columns of the cleaning fluid. Accordingly, there is no need to strictly determine the positional relationship therebetween, the structure required for the positioning is simplified, and the assembly operation can be easily performed, thereby reducing the manufacturing costs.

Note that the suction force obtained by the vacuum nozzle is preferably set to low enough that the internal pressure of the liquid material provided in the inkjet head is not affected, through each of the liquid material ejection ports.

Further, in order to attain the above-mentioned fourth technical object of the present invention, there is provided an inkjet head wiping device, for cleaning a liquid material ejection port of an inkjet head and/or a vicinity thereof, including a cleaning mobile unit which includes: a vacuum nozzle for generating a negative pressure in the liquid material ejection port and/or the vicinity thereof; and a gas injection nozzle for injecting and supplying a gas to the liquid material ejection port and/or the vicinity thereof, and which is relatively movable with respect to the inkjet head. Here, examples of the "gas" described above include air, nitrogen, and argon.

With the structure, in the case of cleaning the liquid material ejection port of the inkjet head and/or the vicinity thereof, by injecting the gas to the cleaning portion from the gas injection nozzle, while foreign matters such as a solidified material of the liquid material and dust which are attached to the cleaning portion are removed, the foreign matters or the like are sucked from the cleaning portion by the vacuum nozzle. Accordingly, as compared with the case of sucking the foreign matters or the like from the cleaning portion only by the suction force of the vacuum nozzle, the cleaning portion can be more reliably made clean. In addition, the whole amount or the substantially whole amount of a gas to be sucked by the vacuum nozzle is obtained as the gas injected from the gas injection nozzle. For this reason, it is possible to avoid the problem of sucking contaminated air, dust, or the like existing in the vicinity thereof. Further, it is possible to effectively avoid the problem which arises when the cleaning fluid is used as in the conventional case, that is, the problem in that the cleaning fluid enters the inkjet head through the liquid material ejection ports of the inkjet head to be mixed into the liquid material, thereby lowering the concentration of the liquid material.

Also in this case, it is desirable that all the components of the cleaning mobile unit including the vacuum nozzle and the gas injection nozzle be maintained not to be in contact with the inkjet head.

With the structure, it is possible to obtain the operations and effects of the present invention to attain the above-mentioned third technical object, and the operations and effects of the present invention to attain the fourth technical object.

Further, in the invention which is accomplished to attain the fourth object, the gas injection port of the gas injection nozzle can be disposed at a position deflected from a position facing the liquid material ejection port of the inkjet head.

With the structure, the gas injection port of the gas injection nozzle is not opposed to each of the liquid material ejection ports of the inkjet head. Accordingly, it is possible to avoid the situation in which the gas injected from the gas injection port of the gas injection nozzle directly enters the inkjet head through the liquid material ejection ports of the inkjet head to press the liquid material. As a result, it is possible to avoid the problems of excessive change of the internal pressure of the liquid material, scattering of the liquid material to the outside, and the like, due to an excessive pressuring force or blowing air to be applied to the liquid material provided inside the inkjet head.

When the inkjet head wiping device having the above-mentioned structure is provided to the inkjet head for forming an oriented film on a substrate, the oriented film forming device can be structured.

In other words, the inkjet head wiping device having the above-mentioned structure can be used for an inkjet printer for performing printing or the like on a sheet, a device for applying a color filter onto a substrate (transparent substrate) of an organic EL display device, and the like. However, the inkjet head wiping device can be suitably used for the oriented film forming device for forming an oriented film on a substrate (transparent substrate) of a liquid crystal display device. The liquid material used in this case has, for example, a viscosity of 5 to 16 cp, and a surface tension of 30 to 40 dyn/cm.

EFFECTS OF THE INVENTION

As described above, in the liquid feeding device for inkjet heads according to the present invention which is accomplished to attain the first technical object, even when the liquid material fed from one ink tank flows into the common liquid feed pipe line together with the gas, the gas is released into the atmosphere from the separate gas flow pipe lines through the common gas flow pipe line which is opened to the atmosphere. As a result, it is possible to avoid the situation in which the gas flows through the separate liquid feed pipe lines together with the liquid material and remains in each of the inkjet heads, and to effectively prevent the ejection of the liquid material from each of the inkjet heads from inhibiting. Further, while the liquid material flows from the common liquid feed pipe line to each of the separate liquid feed pipe lines and remains in each of the inkjet heads, the gas is rapidly released from the common gas flow pipe line through the separate gas flow pipe lines, so the liquid materials flowing to each of the inkjet heads mutually have the uniform pressure. As a result, there occurs no variation in ejection of the liquid material from each of the inkjet heads and it becomes possible to eject the liquid material from each of the inkjet heads in a state where excellent responsiveness is secured. Further, the separate liquid feed pipe lines are each connected to the common gas flow pipe line which can be opened to the atmosphere, thereby simplifying the structures of all the pipe lines for circulating the liquid material and the gas. In addition, it is possible to reduce the number of the control means constituted by valve means and the like, for controlling starting and stopping of feeding of the liquid material from the ink tank to each of the inkjet heads, and also reduce the number of control means constituted by valve means and the like for releasing and enclosing the gas with respect to the atmosphere, thereby making it possible to simplify the structure of the liquid feeding device and reduce the manufacturing costs.

Further, in the liquid feeding device for inkjet heads according to the present invention which is accomplished to attain the second technical object, only a part of the deaerating tube, which has gas permeability and is made of a synthetic resin, is covered with the deaerating unit in the liquid feeding direction, and the internal flow path of the deaerating tube is a single path. For this reason, when the liquid material is flown into the deaerating unit, a stirring flow, turbulence, or the like due to stagnation of the flow of the liquid material is not generated. As a result, there occurs no situation in which air bubbles are generated in the liquid material provided in the deaerating tube and the amount of the dissolved gas is increased. In addition, the inhibition of the ejection of the liquid material due to the air bubbles can be suppressed as much as possible. Further, there is no need to set the inner diameter of the deaerating tube to be as small as that of each unit hollow fiber of the conventional hollow fiber membrane, so it is possible to reduce the flow resistance and smoothly feed the liquid material even at low pressure. This contributes to the reduction in manufacturing costs, prevention of breakage of the liquid feed path, and the reduction in pressure drop, and makes it possible to perform deaeration while smoothly feeding the liquid material even when the liquid material having high viscosity is used. In addition, in the case of cleaning the liquid feed path, it is sufficient to clean the internal flow path of the deaerating tube which is smoothly and continuously formed. Accordingly, as compared with the conventional case of using the hollow fiber membrane, the cleaning of the deaerating unit can be performed with ease and reliability, and there hardly arise a problem in that the liquid material, foreign matters, or solidified materials thereof are attached to the internal flow path and the like, which inhibits the feeding of the liquid material. In addition, when the deaerating unit is mounted to the liquid feed path, it is sufficient to cover a desired part of the deaerating tube by the enclosure. As a result, it is possible to avoid the problem in that the position for disposing the deaerating unit is unambiguously determined, and the degree of freedom of layout in the case of disposing the deaerating unit is increased. Further, application of the inkjet head liquid feed device to a large printer including a plurality of inkjet heads contributes to compactization, and makes it possible to easily perform the maintenance work.

Further, in the inkjet head wiping device according to the present invention which is accomplished to attain the third technical object, the cleaning mobile unit having the vacuum nozzle is structured such that all the components thereof are completely separated from the inkjet head so as to be maintained in a contactless state. Accordingly, the following problems do not arise. That is, the generation of flaws due to the contact between some of the components of the cleaning mobile unit and the inkjet head, the deterioration in durability due to the generation of flaws, the attachment of foreign matters such as wear dust to the liquid material ejection port of the inkjet head and the vicinity thereof, the ejection failure of the liquid, the printing failure or an oriented film formation failure, and the negative pressure suction failure, due to the attachment of the foreign matters, and the like. In addition, there occurs no situation in which the cleaning mobile unit and the inkjet head are brought into contact with each other through the intermediation of the liquid columns of the cleaning fluid. As a result, there is no need to strictly determine the positional relationship therebetween, the structure required for the positioning is simplified, and the assembly operation can be easily performed, thereby reducing the manufacturing costs.

Further, in the inkjet head wiping device according to the present invention which is accomplished to attain the fourth technical object, there are provided the cleaning mobile unit having the vacuum nozzle and the gas injection nozzle. Accordingly, as compared with the case of sucking the foreign matters or the like from the cleaning portion only by the suction force of the vacuum nozzle, the cleaning portion can be more reliably cleaned, and the whole amount or the substantially whole amount of the gas to be sucked by the vacuum nozzle can be obtained as the gas injected from the gas injection nozzle. As a result, it is possible to avoid the problem in that the contaminated air, the dust, or the like provided in the vicinity thereof are sucked by the vacuum nozzle. In addition, it is possible to effectively avoid the problem which arises when the cleaning fluid is used as in the conventional case, that is, the problem in which the cleaning fluid enters the inkjet head through the liquid material ejection ports of the inkjet head to be mixed into the liquid material, thereby lowering the concentration of the liquid material.

DESCRIPTION OF REFERENCE NUMERALS

Figure 1:
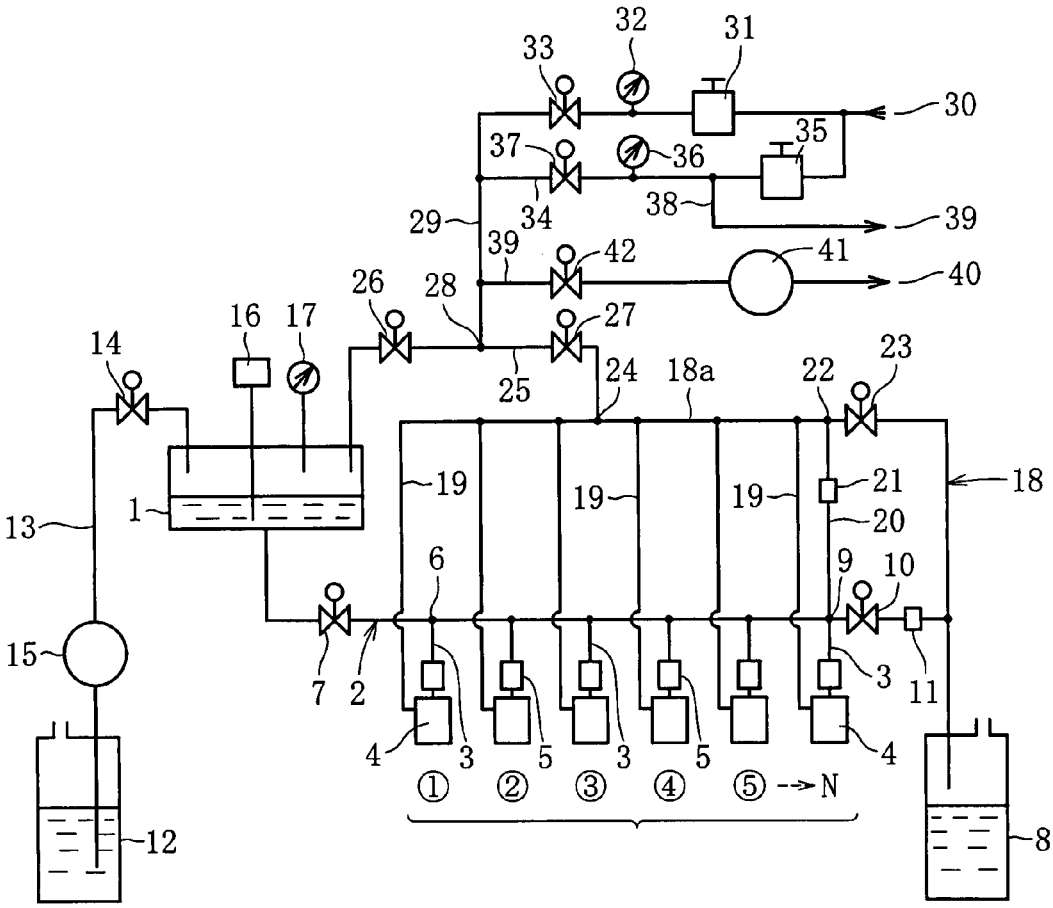
FIG. 1 is a schematic diagram illustrating a whole structure of a liquid feeding device for inkjet heads according to a first embodiment of the present invention.

1 ink tank
2 common liquid feed pipe line
3 separate liquid feed pipe line
4 inkjet head
8 recovery tank
18 common gas flow pipe line
18*a* bypass pipe line
19 separate gas flow pipe line
30 gas pressure source
41 negative pressure pump (negative pressure source)

DETAILED DESCRIPTION OF THE INVENTION

Hereinafter, embodiments of the present invention will be described with reference to the attached drawings.

First Embodiment

FIG. 1 illustrates a liquid feeding device for inkjet heads according to a first embodiment of the present invention. As illustrated in the figure, in the liquid feeding device for inkjet heads according to the first embodiment, an ink tank 1 for storing a liquid material communicates with a common liquid feed pipe line 2 extending in a horizontal direction at a position below the ink tank 1, and a plurality of separate liquid feed pipe lines 3 are each connected to the common liquid feed pipe line 2 at the same intervals. The separate liquid feed pipe lines 3 each extend downward from the common liquid feed pipe line 2, a lower end of each of the separate liquid feed pipe lines 3 is connected to each of inkjet heads 4 (liquid pool provided inside thereof), and deaerating means 5 for removing bubbles of air or the like contained in the liquid material is provided halfway in a longitudinal direction thereof. Note that 6 inkjet heads 4 are provided in the illustrated example, but n number or more of inkjet heads may be provided. In addition, each of the deaerating means and each of the inkjet heads 4 may be separated from each other, may be integrated with each other, or may be separated from each other as separate bodies as illustrated in the figure. A single ink tank 1 is provided so as to store one kind of liquid material (for example, oriented film material).

A liquid feed valve 7 having an opening/closing function is disposed on the common liquid feed pipe line 2, at an upperstream side of a connection portion 6 between the separate liquid feed pipe line 3 positioned at the uppermost stream end, and the common liquid feed pipe line 2. On the other hand, a downstream end of the common liquid feed pipe line 2 communicates with a recovery tank 8 for recovering an extra liquid material flowing through the common liquid feed pipe line 2. The recovery tank 8 is provided at a position below the common liquid feed pipe line 2. A recovery valve 10 having an opening/closing function is provided on the common liquid feed pipe line 2, at a downstream side of a connection portion 9 between the separate liquid feed pipe line 3 positioned at the lowermost stream end, and the common liquid feed pipe line 2. Further, at the upstream side thereof, a recovery sensor 11 for detecting passage or existence of the liquid material is disposed.

At a position below the ink tank 1, there is provided a supply tank 12 having a relatively large capacity, for storing the liquid material, and the supply tank 12 and the ink tank 1 communicate with each other through an initial supply pipe line 13. Halfway on the initial supply pipe line 13, there are disposed a supply valve 14 having an opening/closing function, and a supply pump 15 positioned closer to the supply tank 12 than the supply valve 14. Note that the ink tank 1 is provided with a level switch 16 for controlling a position of a liquid surface of the liquid material stored therein, and an internal pressure gauge 17 for measuring an internal pressure of a space provided above the liquid surface.

On the other hand, in the liquid feeding device for inkjet heads, there extends a common gas flow pipe line 18 which includes a bypass pipe line 18*a* extending in a horizontal direction at a position above the ink tank 1, specifically, at a position above an uppermost liquid level of the ink tank 1. The common gas flow pipe line 18*a* of the common gas flow pipe line 18 is connected with a plurality of separate gas flow pipe lines 19, and the separate gas flow pipe lines 19 extend downward from the bypass pipe line 18*a*. A lower end of each of the separate gas flow pipe lines 19 is connected to each of the inkjet heads 4 (liquid pool provided inside thereof). In addition, the connection portion 9 between the separate liquid feed pipe line 3 positioned at the lowermost stream end, and the common liquid feed pipe line 2 communicates with a liquid feed gas flow pipe line 20 extending downward from the bypass pipe line 18*a* (common gas flow pipe line 18). At a predetermined position of the liquid feed gas flow pipe line 20 in the longitudinal direction, a liquid filling confirmation sensor 21 is disposed. Further, one end of the bypass pipe line 18*a* (common gas flow pipe line 18) is merged into a downstream end of the common liquid feed pipe line 2 to communicate with the recovery tank 8. In addition, a gas releasing valve 23 having an opening/closing function is provided on the bypass pipe line 18*a*, at a position closer to the recovery tank 8 than a connection portion 22 between the bypass pipe line 18*a* and the liquid feed gas flow pipeline 20. Accordingly, one end of the common gas flow pipe line 18 is configured to be opened and closed with respect to the atmosphere.

Further, a middle portion 24 on the bypass pipe line 18*a* of the common gas flow pipe line 18 communicates with the space provided above the liquid surface in the ink tank 1 through a pressure variable base pipe line 25. Halfway on the pressure variable base pipe line 25, a tank valve 26 and a bypass valve 27 are disposed in the stated order from the ink tank 1 side. A middle portion 28 between the installation positions for the valves 26 and 27 on the pressure variable base pipe line 25 is connected with a proximal end of a pressure control pipe line 29. At a leading end of the pressure control pipe line 29, a gas pressure source 30 for nitrogen or the like, a purge pressure regulator (30 KPa) 31, a purge pressure gauge 32, and a purge valve 33 are disposed in the stated order from the leading end side. A leading end of a return pipe line 34 which branches from the proximal end side of the purge valve 33 on the pressure control pipe line 29 returns to be connected between the gas pressure source 30 and the purge pressure regulator 31 on the pressure control pipe line 29. On the return pipe line 34, an atmosphere releasing regulator (1 KPa) 35, an atmosphere releasing pressure gauge 36, and an atmosphere releasing valve 37 are disposed in the stated order from the leading end side. A leading end of an auxiliary branch pipe line 38, which branches from a connection portion between the atmosphere releasing regulator 35 and the atmosphere releasing pressure gauge 36 on the return pipe line 34, communicates with an atmosphere releasing portion 39. Accordingly, a portion between the atmosphere releasing valve 37 and the auxiliary branch 38 is set at substantially an atmospheric pressure. Further, on the branch pipe line 39, which branches from the pressure control pipe line 29 on the proximal end side of the return pipe line 34, an atmosphere releasing portion 40, a negative pressure pump 41, and a negative pressure valve 42 are disposed in the state order from the leading end side.

Next, description is given of operations of the liquid feeding device for inkjet heads according to the first embodiment.

As regards control of a storage amount of the liquid material stored in the ink tank 1, the liquid material is supplied from the supply tank 12 storing a large volume of liquid material to the ink tank 1 through the supply valve 14 which is in an opened state. In this case the level of the liquid surface of the liquid material contained in the ink tank 1 is controlled through a level switch 16. As a result, the interior of the ink tank 1 is maintained to be in a state where a predetermined amount of the liquid material is stored.

Next, in a case where the liquid material is fed to a plurality of inkjet heads 4 from the ink tank 1, in a state where the purge valve 33 provided on the pressure control pipe line 29 and the tank valve 26 provided on the pressure variable base pipe line 25 are opened, a gas such as nitrogen is pressure-fed to the space provided above the liquid surface in the ink tank 1, to thereby increase an internal pressure of the space. In this state, the liquid feed valve 7 and the recovery valve 10, which are provided on the common liquid feed pipe line 2, and the gas releasing valve 23 provided on the bypass pipe line 18*a* (common gas flow pipe line 18) are opened, to thereby feed the liquid material contained in the ink tank 1 to each of the inkjet heads 4 through the common liquid feed pipe line 2 and through each of the separate liquid feed pipe lines 3. In this case, the gas fed in the common liquid flow pipe line 2 together with the liquid material flows into the bypass pipe line 18*a* (common gas flow pipe line 18) through the recovery valve 10 to be released into the atmosphere, and the gas contained in each of the inkjet heads 4 flows into the bypass pipe line 18*a* through each of the separate gas flow pipe lines 19 to be released into the atmosphere through the gas releasing valve 23.

After that, by continuously feeding the liquid material, each of the inkjet heads 4 is filled with the liquid material. At this point of time, the internal pressures of the inkjet heads 4 are equalized through the intermediation of the bypass pipe line 18*a* of the common gas flow pipe line 18, with the result that the inkjet heads 4 are equally filled with the liquid material. At a time point when the liquid material reaches the recovery sensor 11 from the common liquid feed pipe line 2 through the recovery valve 10, the recovery valve 10 is closed. Further, at a time point when the liquid filling confirmation sensor 21 detects that the liquid material ascends to a predetermined position in the liquid feed gas flow pipe 20, the gas releasing valve 23 is closed, and at a time point when the liquid material filled in each of the inkjet heads 4 reaches an ejection nozzle of each of the inkjet heads 4 and drops, the purge valve 33 and the liquid feed valve 7 are closed. Thus, the operation of feeding the liquid from the ink tank 1 to each of the inkjet heads 4 is completed. In this case, the position of the liquid surface of the ink tank 1 and the installation position of the liquid filling confirmation sensor 21 are set to be the same or substantially the same height position. Accordingly, in each of the separate gas flow pipe lines 19, the liquid material ascends to the height position equal to or substantially equal to the installation position of the liquid filling confirmation sensor 21.

At this point of time, the interior of each of the inkjet heads 4 and the ink tank 1 is pressurized, so the atmosphere releasing valve 37 is first opened so as to set the internal pressures thereof to the atmospheric pressure. In this case, the atmosphere releasing regulator 35 allows nitrogen to be constantly released into the atmosphere through the auxiliary branch pipe line 38 at a pressure of 0.1 kPa so as to prevent backflow of the atmosphere. Accordingly, the auxiliary branch pipe line 38 is depressurized to almost the atmospheric pressure through the atmosphere releasing valve 37. After that, the atmosphere releasing valve 37 is closed, and the negative pressure valve 42, the tank valve 26, the bypass valve 27, and the liquid feed valve 7 are each opened to lower the internal pressure of each of the inkjet heads 4 to a predetermined negative pressure through the operation of the negative pressure pump 41, thereby being ready for appropriately ejecting the liquid material from each of the inkjet heads 4. At this point of time, the liquid material contained in each of the inkjet heads 4 is affected by the negative pressure acting on the space provided above the liquid surface in the ink tank 1 and by the negative pressure acting on the bypass pipe line 18*a*. Therefore, the negative pressure acts on the liquid material contained in each of the inkjet heads 4 with uniformity, excellent responsiveness, and stability.

Second Embodiment

Figure 2:
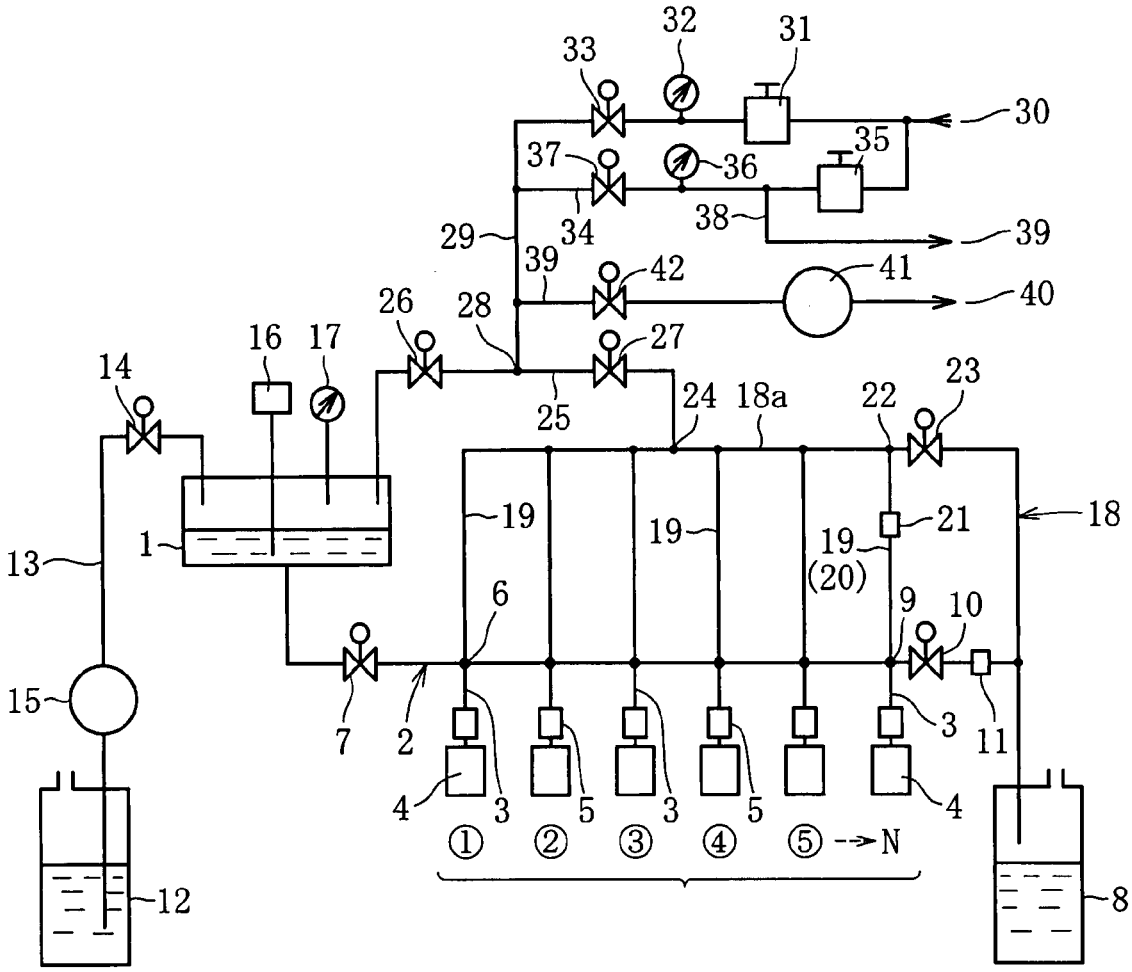
FIG. 2 is a schematic diagram illustrating a whole structure of a liquid feeding device for inkjet heads according to a second embodiment of the present invention.

FIG. 2 illustrates a liquid feeding device for inkjet heads according to a second embodiment of the present invention. The liquid feeding device for inkjet heads of the second embodiment is different from the liquid feeding device for inkjet heads of the first embodiment in that each lower end of the separate gas flow pipe lines 19 extending downward from the bypass pipe line 18*a* of the common gas flow pipe line 18 communicates with each connection portion between the common liquid feed pipe line 2 and each of the separate liquid feed pipe lines 3, and in that the separate gas flow pipe line 19 provided on the lowermost downstream end also functions as the liquid feed gas flow pipe line 20. The other components of the liquid feeding device for inkjet heads according to the second embodiment are the same as those of the liquid feeding device for inkjet heads of the first embodiment, so the components common to those devices are denoted by the same reference symbols, and redundant explanation is omitted.

In the liquid feeding device for inkjet heads according to the second embodiment, a gas flowing through the common liquid feed pipe line 2 flows into the common gas flow pipe line 18 from the connection portions through each of the separate gas flow pipe lines 19, and then, the gas is released into the atmosphere. In addition, the internal pressures of the inkjet heads 5 are equalized due to the bypass pipe line 18*a*. Further, the negative pressure generated through the operation of the negative pressure pump 41 equally acts on the separate liquid feed pipe lines 3 through each of the separate gas flow pipe lines 19, which makes it possible to eject the liquid material from each of the inkjet heads 4 with efficiency. The other actions and effects are the same as those of the first embodiment, so explanation thereof is omitted.

Note that in each of the structures according to the first embodiment and the second embodiment, the lower end of each of the separate gas flow pipe lines 19 may be connected at a halfway position of a portion between each connection portion between the common liquid feed pipe line 2 and each of the liquid feed pipe line 3, and each of the inkjet heads 4, that is, at a halfway position on each of the separate liquid feed pipe lines 3, or at an entrance or an exit of the deaerating means 5.

Third Embodiment

Figure 3:
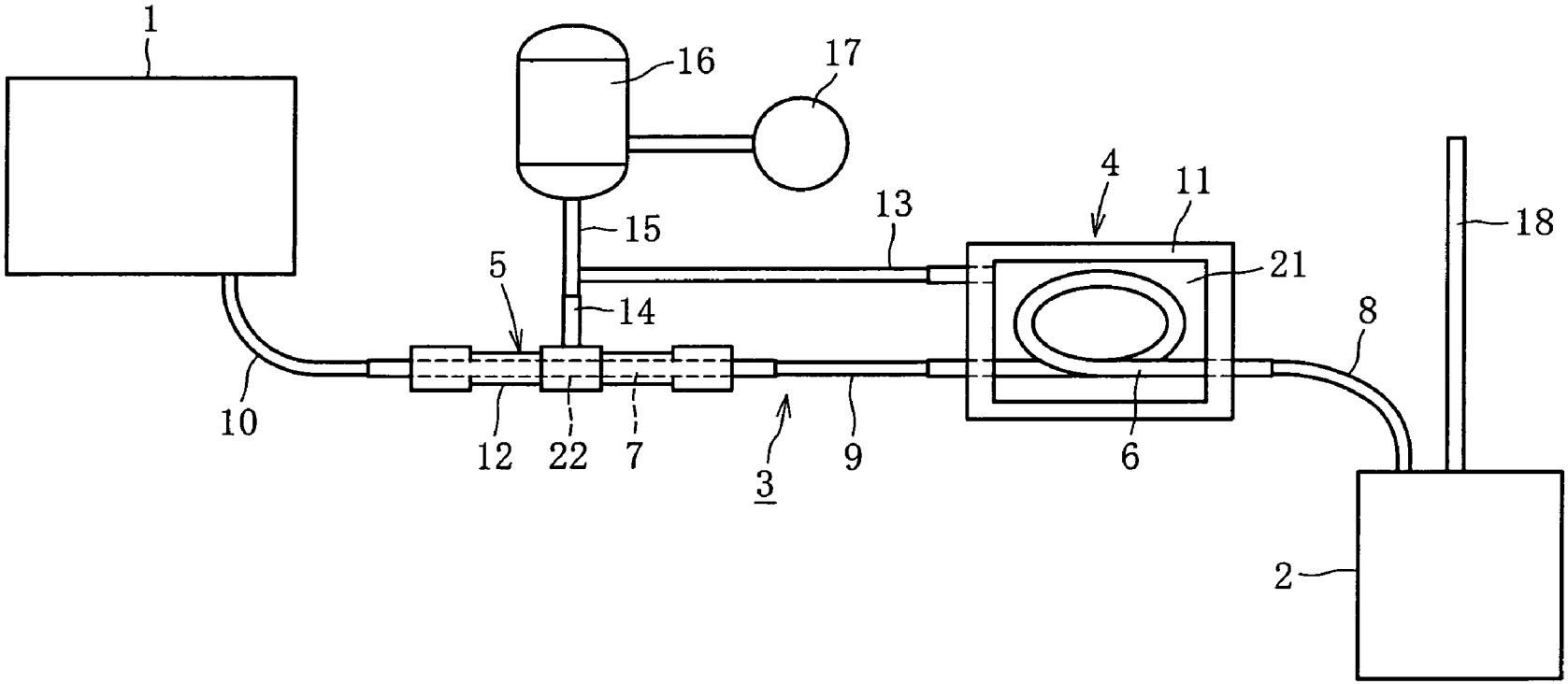
FIG. 3 is a schematic diagram illustrating a whole structure of a liquid feeding device for inkjet heads according to a third embodiment of the present invention.
Figure 4:
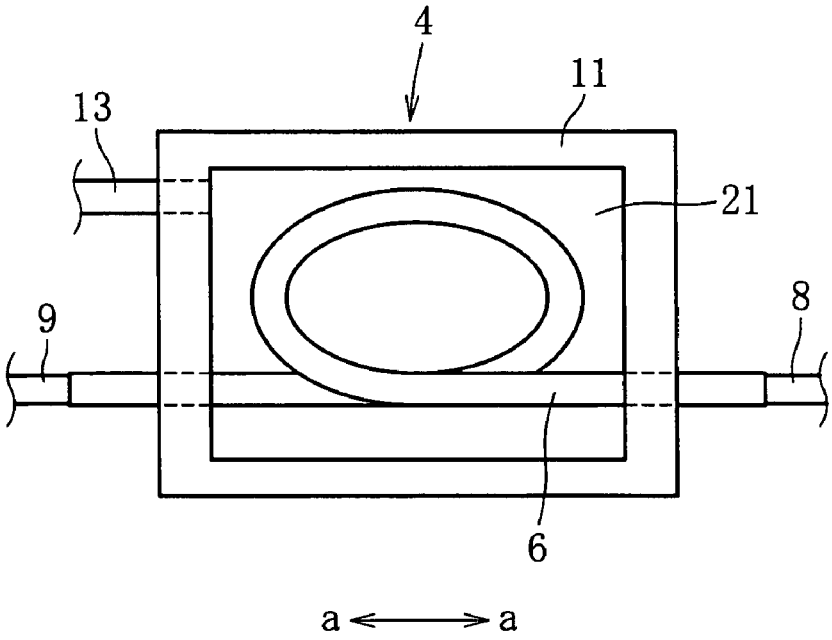
FIG. 4 is an enlarged schematic diagram illustrating a first deaerating unit which is a component of the liquid feeding device for inkjet heads according to the third embodiment of the present invention.
Figure 5:
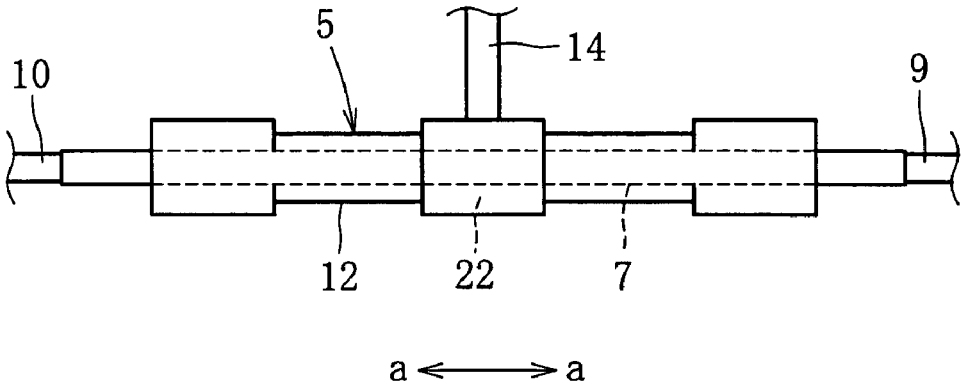
FIG. 5 is an enlarged schematic diagram illustrating a second deaerating unit which is a component of the liquid feeding device for inkjet heads according to the third embodiment of the present invention.

FIGS. 3 to 5 each illustrate a liquid feeding device for inkjet heads according to a third embodiment of the present invention. As illustrated in FIG. 3, the liquid feeding device for inkjet heads according to the third embodiment includes a liquid feed path 3 for feeding the liquid material to an inkjet head 2 (liquid pool provided inside thereof) from the ink tank 1 storing the liquid material, and a first deaerating unit 4 and a second deaerating unit 5 provided at two positions halfway on the liquid feed path 3. The liquid feed path 3 is formed by connecting two deaerating tubes (hereinafter, referred to as "first deaerating tube 6 and second deaerating tube 7") and three liquid feed tubes (hereinafter, referred to as "first liquid feed tube 8, second liquid feed tube 9, and third liquid feed tube 10") to one another. Each of the first deaerating tube 6 and the second deaerating tube 7 has gas permeability, and is made of a synthetic resin, in which a single internal flow path is formed. Each of the first liquid feed tube 8, the second liquid feed tube 9, and the third liquid feed tube 10 does not have gas permeability, and is made of a metal, in which a single internal flow path is formed. In this case, the first and second deaerating tubes 6 and 7 are each obtained by cutting a tube manufactured by SMC Corporation (product name: Teflon Tube (Type: TL-0403-20)) into a predetermined length (for example, 500 mm). In the third embodiment, a tube having an inner diameter of 3.0 mm, an outer diameter of 4.0 mm, and a wall thickness of 0.5 mm is used.

Specifically, the liquid feed path 3 includes the first liquid feed tube 8, which is connected to the inkjet head 2 and is provided on a downstream end of the liquid feed path 3, the first deaerating tube 6, which is connected to the upstream end of the liquid feed tube 8 and is a component of the first deaerating unit 4, the second liquid feed tube 9, which is connected to the upstream end of the deaerating tube 6 and is provided at the midpoint of the liquid feed path 3, the second deaerating tube 7, which is connected to the upstream of the second liquid tube 9 and is a component of the second deaerating unit 5, and the third liquid feed tube 10 which is connected to the upstream end of the second deaerating tube 7 and to the ink tank 1, and is provided on an upstream end of the liquid feed path 3.

The first deaerating unit 4 is structured such that an outer surface side of the first deaerating tube 6 is covered with a first enclosure 11, and the second deaerating unit 5 is structured such that an outer surface side of the second deaerating tube 7 is covered with a second enclosure 12. In addition, the first enclosure 11 is connected with a first vacuum tube 13, and the second enclosure 12 is connected with a second vacuum tube 14. The first vacuum tube 13 and the second vacuum tube 14 are merged into an aggregate vacuum tube 15 to be connected to a vacuum tank 16, and the vacuum tank 16 is connected with a vacuum pump 17. Note that the inkjet head 2 is connected with an electrical signal cable 18 for controlling various operations including an operation of ejecting the liquid material from the ejection nozzle.

Specifically, as illustrated in FIG. 4, in the first deaerating unit 4, the outer surface side of the first deaerating tube 6 is covered with the first enclosure 11 which is formed of a box-like (rectangular) container, and the first deaerating tube 6 penetrates the first enclosure 11 in a liquid feeding direction (a-a direction) and extends to the upstream side and to the downstream side. In other words, the first enclosure 11 covers a part of the first deaerating tube 6 which is positioned in the middle of the liquid feeding direction. The first deaerating tube 6 is wound a plurality of times (for example, 5 times) in an internal accommodation space 21 of the first enclosure 11 to be formed into a coil shape. As a result, the length of the first deaerating tube 6 accommodated in the internal accommodation space 21 is set to 1.5 to 50 times, or preferably about 8 to 12 times longer than that of the first enclosure 11 in the liquid feeding direction. In addition, the upper limit of the length of the tube to be accommodated in the internal accommodation space 21 is set to 500 mm to 1000 mm, or preferably to 800 mm. In this case, the length of the first enclosure 11 in the liquid feeding direction is about 50 to 200 mm.

Further, the internal accommodation space 21 of the first enclosure 11 is blocked from an outside air, and the negative pressure from the vacuum tank 16 is introduced into the internal accommodation space 21 through the first vacuum tube 13 to thereby depressurize the internal accommodation space 21. As a result, the liquid material flowing through the internal flow path of the first deaerating tube 6 is deaerated. A degree of vacuum of the internal accommodation space 21 obtained when the deaeration is performed is set to −97 to −100 KPa, and the amount of dissolved gas contained in the liquid material is, for example, about 2 ml/1000 ml when the deaeration is performed.

In addition, as illustrated in FIG. 5, in the second deaerating unit 5, an outer surface side of the second deaerating tube 7 is covered with the second enclosure 12 formed of a tube-like (cylindrical) container. The second deaerating tube 7 penetrates the second enclosure 12 in the liquid feeding direction (a-a direction) and extends to the upstream side and to the downstream side. Also in this case, the second enclosure 12 covers a part of the second deaerating tube 7 which is positioned in the middle of the liquid feeding direction, but the second deaerating tube 7 linearly extends in the internal accommodation space 22 of the second enclosure 12. The internal accommodation space 22 of the second enclosure 12 is also blocked from the outside air, and the negative pressure from the vacuum tank 16 is introduced into the internal accommodation space 22 through the second vacuum tube 14 to thereby depressurize the internal accommodation space 22. As a result, the liquid material flowing through the internal flow path of the second deaerating tube 7 is deaerated. Also in this case, the degree of vacuum of the internal accommodation space 22 is set to −97 to −100 KPa, and the amount of dissolved gas contained in the liquid material is, for example, about 2 ml/1000 ml when the deaeration is performed.

Note that the liquid material used in the third embodiment is a material for forming an oriented film on a glass substrate which is a primitive plate of a glass panel of a liquid crystal display device, and is characterized by having a viscosity of 5 to 18 cp and a surface tension of 30 to 40 dyn/cm.

In the structure according to the third embodiment as described above, the liquid material is fed to the liquid pool of the inkjet head 2 from the ink tank 1 through the internal flow paths of the first liquid feed tube 8, the first deaerating tube 6, the second liquid feed tube 9, the second deaerating tube 7, and the third liquid feed tube 10. Then, the liquid material is ejected from the ejection nozzle of the inkjet head 2 through an operation of a piezoelectric element. During the time when the liquid material is introduced into the inkjet head 2 through the liquid flow path 3, the deaeration of the dissolved gas is performed at two positions halfway on the liquid flow path 3, namely, by the first deaerating unit 4 and the second deaerating unit 5. As a result, the liquid material containing the dissolved gas at an allowable value (4 ml/1000 ml) or smaller is supplied to the inkjet head 2.

In this case, portions at which deaeration is performed by the first and second deaerating units 4 and 5 are provided with the first and second deaerating tubes 6 and 7 each having gas permeability, and the other exposed portions are provided with the first to third liquid feed tubes 8, 9, and 10 each having no gas permeability. As a result, there occurs no inconveniences due to mixture of air as the dissolved gas into the liquid material through a tube wall of each of the tubes. In other words, the air is hardly mixed into the liquid material as the dissolved gas through the tube wall of each of the liquid feed tubes 8, 9, and 10. In addition, while there exists a small amount of air mixed into the liquid material through the tube walls of the exposed portions of the enclosures 11 and 12 of the deaerating tubes 6 and 7, the amount of the dissolved gas is reduced to be much smaller than the allowable value through the operations of the deaerating units 4 and 5. Accordingly, it is impossible that the amount of the dissolved gas exceeds the above-mentioned allowable value since the amount the dissolved gas is extremely small even when the amount of the dissolved gas is increased due to the mixture of the small amount of air. Therefore, the dissolved gas contained in the liquid material does not have an adverse effect on the ejection and the like of the liquid material from the inkjet head 2.

Note that in the third embodiment, the first and second deaerating units 4 and 5, which have different structures, are arranged in series on the liquid feed path 3. However, two deaerating units having the same structure, or one of the deaerating units may be arranged on the liquid feed path. Alternatively, three or more deaerating units, which have the same structure or different structures, may be arranged in series on the liquid feed path 3.

Fourth Embodiment

Figure 6:
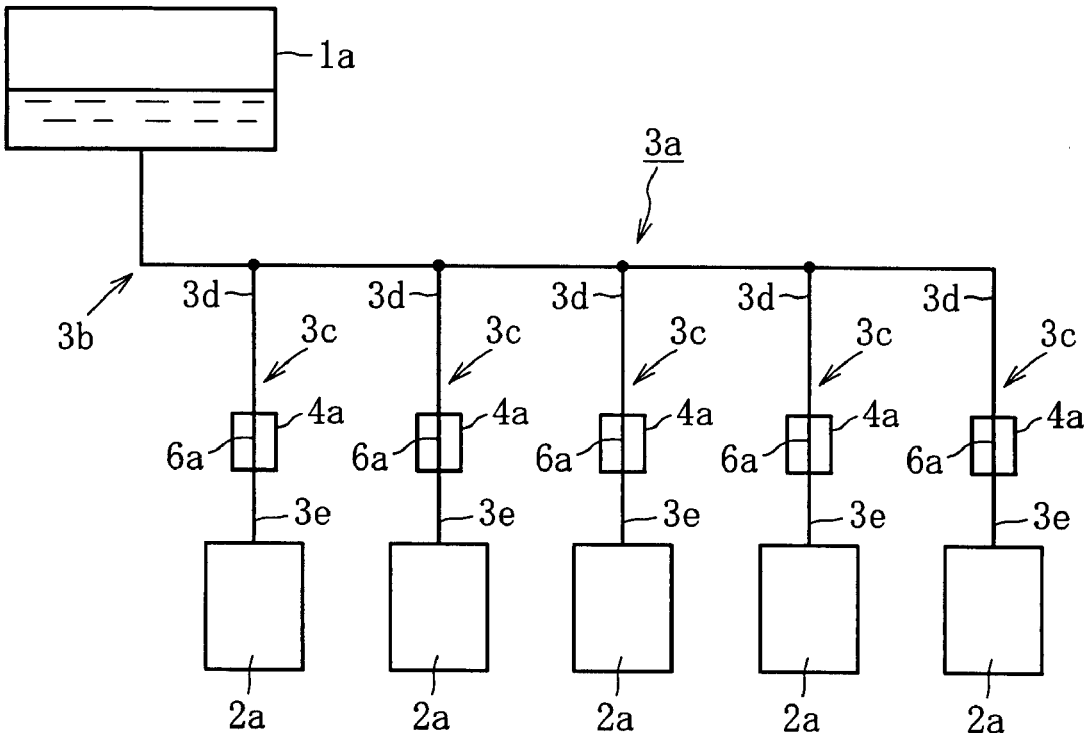
FIG. 6 is a schematic diagram illustrating a whole structure of a liquid feeding device for inkjet heads according to a fourth embodiment of the present invention.

FIG. 6 illustrates a liquid feeding device for inkjet heads according to a fourth embodiment of the present invention. As illustrated in the figure, the liquid feeding device according to the fourth embodiment is mounted to a large printer (oriented film forming device) having a plurality of inkjet heads 2*a* mounted therein, which includes a liquid feed path 3*a* having a main path 3*b* connected to an ink tank 1*a*, and a plurality of branch paths 3*c* each of which branches from the main path 3*b* to be connected to each of the plurality of inkjet heads 2*a*.

Halfway on each of the plurality of branch paths 3*c* in the liquid feeding direction, a deaerating unit 4*a* is provided. The structure and the arranged state of the deaerating unit 4*a* are the same as those of the deaerating units according to the third embodiment. An internal portion and a peripheral portion of the deaerating unit 4*a* on each of the branch paths 3*c* are formed of a deaerating tube 6*a* made of a synthetic resin, which has gas permeability and a single internal flow path formed therein. A peripheral portion 3*d* of a branch position between each of the branch paths 3*c* and the main path 3*b*, and a peripheral portion 3*e* of a connection position to the inkjet head 2*a* are formed of a liquid feed tube made of a metal or the like, which has no gas permeability and has a single internal flow path formed therein. In addition, the main path 3*b* is formed of a similar liquid feed tube. Accordingly, even with the structure of the liquid feeding device, as in the case of the third embodiment, the dissolved gas contained in the liquid material has no adverse effect on ejection and the like of the liquid material from each of the inkjet heads 2*a*.

Note that in each of the third and fourth embodiments, the deaerating unit and the inkjet head 2, which are arranged at portions on the downstream side of the liquid flow path, are structured as separate bodies, but the deaerating unit and the inkjet head 2 may be integrated into a single unit. In addition, in each of the third and fourth embodiments, one deaerating unit is provided to one deaerating tube, but, aside from this, a plurality of deaerating units may be arranged in series with respect to one deaerating tube.

Fifth Embodiment

Figure 7:
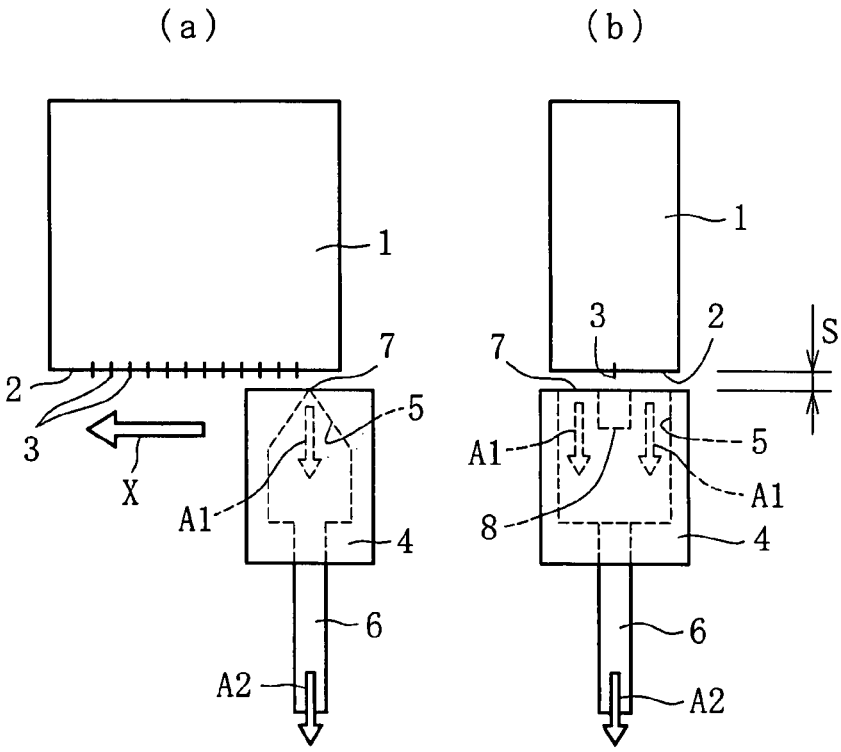
FIG. 7(*a*) is a schematic front diagram illustrating an inkjet head wiping device according to a fifth embodiment of the present invention, and FIG. 7(*b*) is a schematic side diagram illustrating the inkjet head wiping device.

FIGS. 7(*a*) and 7(*b*) each illustrate a liquid feeding device for inkjet heads according to a fifth embodiment of the present invention. As illustrated in the figure, the inkjet head wiping device according to the fifth embodiment includes a cleaning mobile unit 4 for cleaning liquid material ejection ports 3 of a plurality of ejection nozzles and/or the vicinity of the liquid material ejection ports 3. The ejection nozzles are arranged in a longitudinal direction (horizontal direction of FIG. 7(*a*), with a predetermined pitch on one end surface, that is, a nozzle surface 2 of the inkjet head (print head) 1. Note that in FIGS. 7(*a*) and 7(*b*), the liquid material ejection ports 3 (ejection nozzles) are allowed to protrude from the one end surface 2 of the inkjet head 1. However, in the fifth embodiment, the liquid material ejection ports 3 are opened to the one end surface 2 of the inkjet head 1 and do not protrude to the one end surface 2 (the same applies to sixth to ninth embodiments). Note that the present invention does not preclude the use of a liquid material ejection port 3 which protrudes from the one end surface 2 of the inkjet head 1.

The cleaning mobile unit 4 includes a vacuum nozzle 5, and is structured so as to move in the longitudinal direction indicated by the arrow X, that is, in a direction in which the liquid material ejection ports 3 are arranged. All the components of the liquid mobile unit 4 including the vacuum nozzle 5 are completely separated from the inkjet head 1 so as not to be brought into contact with the inkjet head 1 during the use thereof. In this case, a spaced dimension S between the one end surface 2 of the inkjet head 1 and the cleaning mobile unit 4 is in a range from 0.2 mm to 1.0 mm, or preferably in a range from 0.3 mm to 0.7 mm. In the fifth embodiment, the spaced dimension S is set to about 0.5 mm (the same applies to six to ninth embodiments described below). In addition, the vacuum nozzle 5 communicates with a negative pressure source, which is not shown in the figure, through a suction path 6. Inside the vacuum nozzle 5 and inside the suction path 6, a suction air flows in directions indicated by the arrows A1 and A2.

A suction port 7 of the vacuum nozzle 5 is formed into a slit shape which is short in the longitudinal direction, and long in a horizontal direction, that is, a lateral direction (horizontal direction of FIG. 7(*b*)) orthogonal to the longitudinal direction within a surface facing the one end surface 2 of the inkjet head 1. In other words, the dimension of the vacuum nozzle 5 at the suction port 7 in the longitudinal direction is in a range from 0.2 mm to 1.0 mm, or preferably in a range from 0.3 mm to 0.7 mm. In the fifth embodiment, the dimension is set to about 0.5 mm (also in the sixth to ninth embodiments, the dimension of the suction port 7 at the short length side is the same as that of this case). The dimension thereof in the lateral direction is the same or substantially the same as the dimension in the lateral direction of the one end surface 2 of the inkjet head 1. Accordingly, only by moving the vacuum nozzle 5 in the longitudinal direction indicated by the arrow X, a cleaning operation with respect to an entire area of the one end surface 2 of the inkjet head 1 can be performed.

Further, according to the fifth embodiment, at a middle position in the lateral direction of the suction port 7 of the vacuum nozzle 5, there is formed an obstructing portion 8 for preventing each of the liquid material ejection ports 3 of the inkjet heads 1 and the suction port 7 from directly being opposed to each other. Specifically, when the cleaning mobile unit 4 moves in the longitudinal direction X, the obstructing portion 8 of the vacuum nozzle 5 and each of the liquid material ejection ports 3 of the inkjet head 1 are structured to be maintained to be opposed to each other. Accordingly, a suction force of the suction port 7 of the vacuum nozzle 5 due to the negative pressure does not directly act on each of the liquid material ejection ports 3 of the inkjet head 1. With this structure, consideration is given to avoid an adverse effect of the suction force of the vacuum nozzle 5 to be given on the internal pressure of the liquid material provided in the inkjet head, through the liquid material ejection port 3, and to avoid mixture of the air into the liquid material ejection nozzle due to the adverse effect. Note that when the suction force of the vacuum nozzle 5 is set to low enough that the internal pressure of the liquid material provided in the inkjet head is not affected through the liquid material ejection port 3, the above-mentioned obstructing portion 8 can be omitted.

As described above, in the structure according to the fifth embodiment, foreign matters such as a solidified material of a film material and dust which are attached to the one end surface 2 of the inkjet head 1, that is, the liquid material ejection port 3 and the vicinity thereof, are sucked into the vacuum nozzle 5 by the negative pressure acting from the vacuum nozzle 5 of the cleaning mobile unit 4, thereby performing the cleaning operation. Then, the cleaning mobile unit 4 moves in the longitudinal direction indicated by the arrow X while performing the above-mentioned operation, thereby cleaning the whole area or almost the whole area of the one end surface (nozzle surface) 2 of the inkjet head 1.

Due to the fact that all the components of the cleaning mobile unit 4 are completely not in contact with the inkjet head 1, flaws to be generated due to the contact therebetween, deterioration in durability due to the flaws, and the like are not caused. Further, it is possible to avoid attachment of foreign matters such as wear dust to the liquid material ejection port 3 of the inkjet head 1 and the vicinity thereof, a liquid material ejection failure due to the attachment of the foreign matters, a printing failure or an oriented film formation failure, a negative pressure suction failure, and the like. In addition, the cleaning mobile unit 4 and the inkjet head 1 are not brought into contact with each other through the intermediation of liquid columns of a cleaning fluid, so there is no need to strictly determine the positional relationship therebetween. As a result, the structure required for the positioning is simplified and an assembly operation can be easily performed.

Sixth Embodiment

Figure 8:
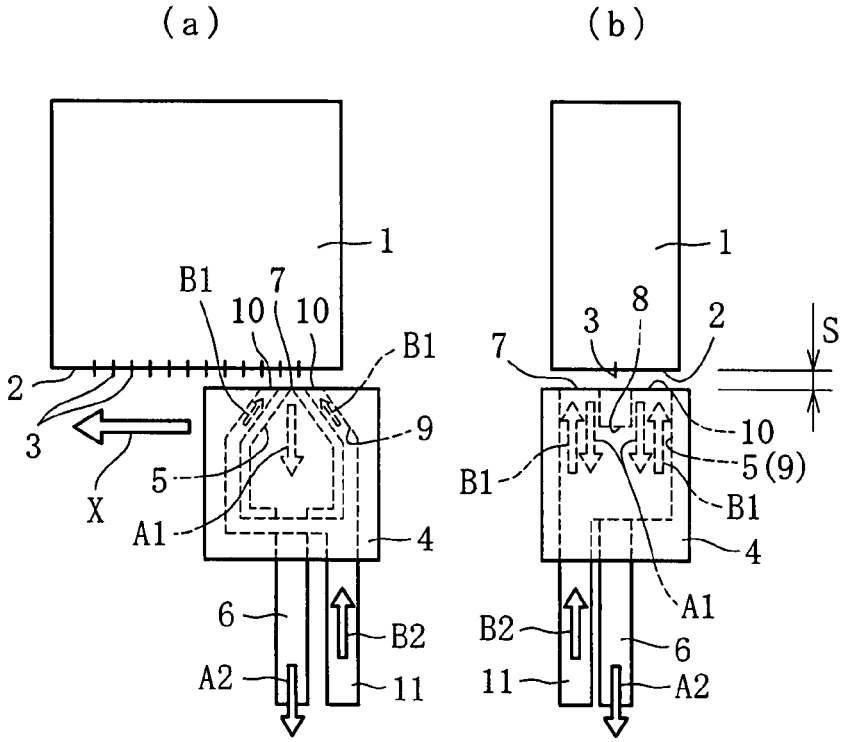
FIG. 8(*a*) is a schematic front diagram illustrating an inkjet head wiping device according to a sixth embodiment of the present invention, and FIG. 8(*b*) is a schematic side diagram illustrating the inkjet head wiping device.

FIG. 8(*a*) is a schematic front diagram illustrating an inkjet head wiping device according to a sixth embodiment of the present invention, and FIG. 8(*b*) is a schematic side diagram illustrating the inkjet head wiping device. Note that in the description of the inkjet head wiping device according to the sixth embodiment with reference to FIGS. 8(*a*) and 8(*b*), components of the sixth embodiment which are common to those of the fifth embodiment are denoted by the same reference symbols, and detailed description thereof is omitted.

As illustrated in FIGS. 8(*a*) and 8(*b*), in the inkjet head wiping device, the cleaning mobile unit 4, which is movable in the longitudinal direction in a completely contactless manner with respect to the one end surface 2 having the liquid material ejection ports 3 of the inkjet head 1 formed thereon, includes not only the vacuum nozzle 5 but also a gas injection nozzle 9 for injecting and supplying a gas such as air or nitrogen to the one end surface 2 of the inkjet head 1. An area for injecting the gas by the gas injection nozzle 9 on the one end surface 2 of the inkjet head 1 substantially corresponds to an area for suction by the vacuum nozzle 5. Specifically, the gas injection area contains the entirety of the suction area.

The suction port 7 of the vacuum nozzle 5 is formed into a slit shape which is short in the longitudinal direction and long in the lateral direction. Similarly, gas injection ports 10 of the gas injection nozzle 9 is formed into a slit shape which is short in the longitudinal direction and long in the lateral direction, and the two gas injection ports 10 are formed on both sides in the longitudinal direction with the single suction port 7 being as a center. The two gas injection ports 10 are spaced apart from the suction port 7, and in the similar manner as the obstructing portion 8 of the suction port 7, the obstructing portion 8 provided for preventing each of the liquid material ejection ports 3 and the gas injection ports 10 from being directly opposed to each other is formed at the middle position in the lateral direction of each of the gas injection ports 10. In other words, there is employed a structure in which the gas is not directly injected and supplied from the gas injection ports 10 with respect to each of the liquid material ejection ports 3 of the inkjet head 1. With this structure, consideration is given to avoid, for example, an adverse effect of the gas injected and supplied from the gas injection ports 10 on the internal pressure of the liquid material provided in the inkjet head, through the liquid material ejection port 3, and scattering of the liquid material.

In this case, the gas injection nozzle 9, which has the two gas injection ports 10 at a leading end thereof, communicates with a gas pressure source, which is not shown in the figure, through one liquid feed path 11. In addition, injection paths each communicating with each of the two gas injection ports 10 of the gas injection nozzle 9 are inclined so as to gradually come closer to each other as being closer to the inkjet head 1 side. Inside the gas injection nozzle 9 and inside the liquid feed paths 11, the gas flows in directions indicated by the arrows B1 and B2. Note that a gas flow path leading from the liquid feed path 11 to the gas injection port 10, and a suction air flow path leading from the suction port 7 to the suction path 6 are in a completely isolated state. In addition, the dimension of each of the gas injection ports 10 in the longitudinal direction is longer than the dimension of the suction port 7 in the longitudinal direction. Meanwhile, the dimension of each of the gas injection ports 10 in the lateral direction, and the dimension of the suction port 7 in the lateral direction are the same or substantially the same.

As described above, in the structure according to the sixth embodiment, the foreign matters such as a solidified material of the film material and dust, which are attached to the one end surface 2, that is, the liquid material ejection port 3 of the inkjet head 1 and the vicinity thereof, are further removed by the gas injected from the gas injection nozzle 9 of the cleaning mobile unit 4. At the same time, the foreign matters and the like are sucked into the vacuum nozzle 5 by the negative pressure acting from the vacuum nozzle 5. The cleaning mobile unit 4 moves in the longitudinal direction indicated by the arrow X while performing the above-mentioned operation, thereby cleaning the whole area or almost the whole area of the one end surface (nozzle surface) 2 of the inkjet head 1. In this case, in the vacuum nozzle 5, only the gas injected from the gas injection nozzle 9, or substantially only the gas, and the foreign matters, and the like are sucked. Accordingly, it is possible to prevent contaminated air, dust, and the like provided in the vicinity thereof from being sucked into the vacuum nozzle 5. Note that the other actions and effects are similar to those of the fifth embodiment.

Seventh Embodiment

Figure 9:
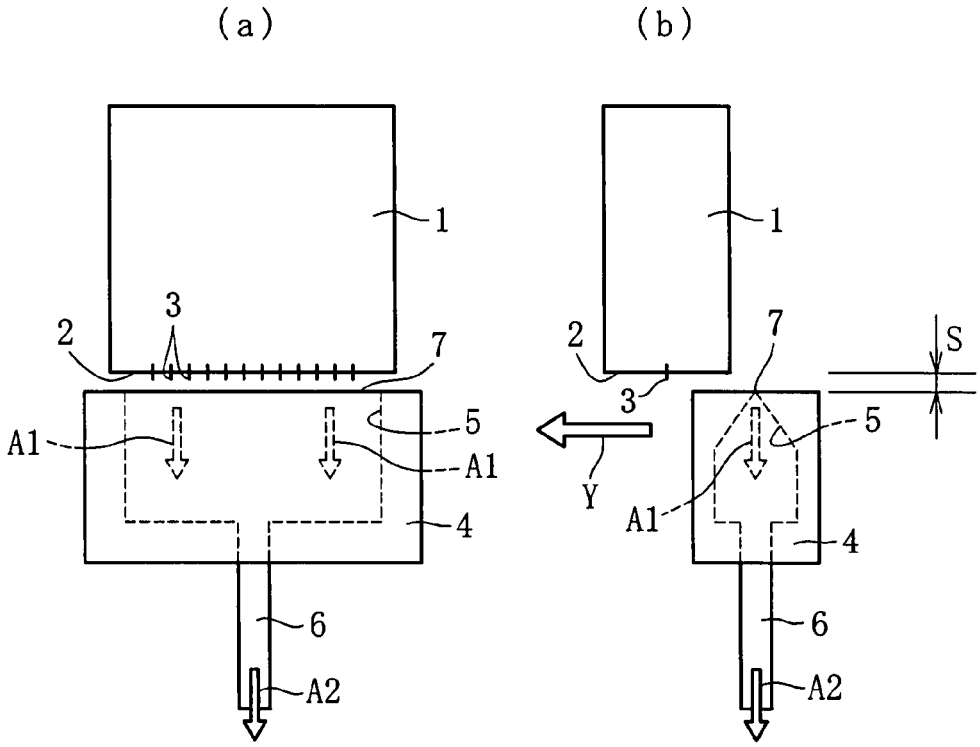
FIG. 9(*a*) is a schematic front diagram illustrating an inkjet head wiping device according to a seventh embodiment of the present invention, and FIG. 9(*b*) is a schematic side diagram illustrating the inkjet head wiping device.

FIG. 9(*a*) is a schematic front diagram illustrating an inkjet head wiping device according to a seventh embodiment of the present invention, and FIG. 9(*b*) is a schematic side diagram illustrating the inkjet head wiping device. Note that in the description of the inkjet head wiping device according to the seventh embodiment with reference to FIGS. 9(*a*) and 9(*b*), components of the seventh embodiment which are common to those of the fifth embodiment are denoted by the same reference symbols, and detailed description thereof is omitted.

As illustrated in FIGS. 9(*a*) and 9(*b*), the inkjet head wiping device has a structure in which the cleaning mobile unit 4 moves in the lateral direction indicated by the arrow Y. In the structure, the dimension of the cleaning mobile unit 4 in the longitudinal direction is set to be substantially equal to or a little longer than the dimension of the inkjet head 1 in the longitudinal direction. The suction port 7 of the vacuum nozzle 5 provided to the cleaning mobile unit 4 is formed into a slit shape which has a short length side in the lateral direction, and is a long length side in the longitudinal direction which is substantially equal to or a little longer than the length of an arrangement area for all the liquid material injection ports 3 of the inkjet head 1. Note that the suction port 7 has no obstructing portion formed therein.

Accordingly, as regards a specific structure of the cleaning mobile unit 4 according to the seventh embodiment, the side diagram thereof illustrated in FIG. 9(*b*) is identical with that as described above regarding the case where the "longitudinal direction" and the "lateral direction" of FIG. 7(*b*) are replaced with each other. In addition, the front diagram thereof illustrated in FIG. 9(*a*) is identical with that as described above (except the description of obstructing portion 8) regarding the case where the "longitudinal direction" and the "lateral direction" of the side diagram illustrated in FIG. 7(*a*) are replaced with each other.

In the structure according to the seventh embodiment, foreign matters such as a solidified material of a film material and dust which are attached to the one end surface 2 (the liquid material ejection port 3 and the vicinity thereof) of the inkjet head 1 are sucked into the vacuum nozzle 5 by the negative pressure acting from the vacuum nozzle 5 of the cleaning mobile unit 4, thereby performing the cleaning operation. Then, the cleaning mobile unit 4 moves in the lateral direction indicated by the arrow Y while performing the above-mentioned operation, thereby cleaning the whole area or substantially the whole area of the one end surface (nozzle surface) 2 of the inkjet head 1.

In this case, during the time when the cleaning mobile unit 4 is moving in the lateral direction indicated by the arrow Y, at the time point when the suction port 7 of the vacuum nozzle 5 and each of the liquid material ejection ports 3 of the inkjet head 1 are opposed to each other, the suction by the vacuum nozzle 5 is temporarily stopped. Accordingly, the suction force due to the negative force does not directly act from the suction port 7 of the vacuum nozzle 5 with respect to each of the liquid material ejection ports 3 of the inkjet head 1. As a result, it is possible to avoid the adverse effect of the suction force of the vacuum nozzle 5 on the internal pressure of the liquid material provided in the inkjet head, through each of the liquid material injection ports 3, and to avoid mixture of the air into the liquid material injection nozzle due to the adverse effect of the suction force. Note that when the suction force of the vacuum nozzle 5 is set to low enough that the internal pressure provided in the inkjet head is not affected, through the liquid material injection port 3, it is unnecessary to temporarily stop the suction. The other operations and effects are the same as those of the fifth embodiment.

Eighth Embodiment

Figure 10:
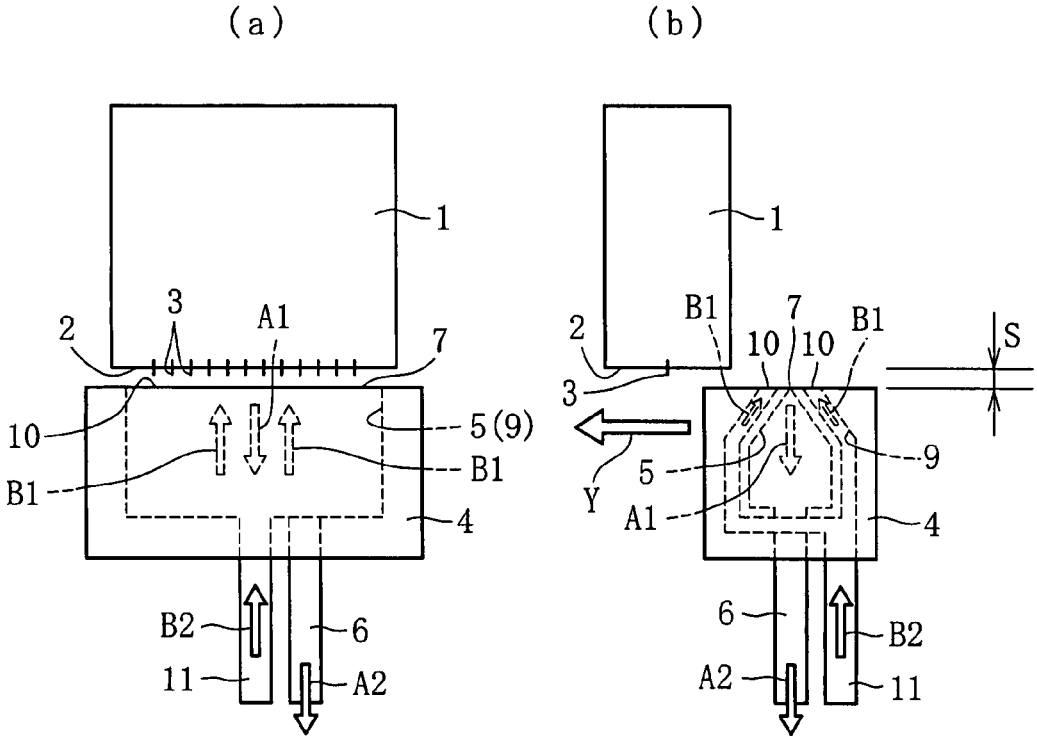
FIG. 10(*a*) is a schematic front diagram illustrating an inkjet head wiping device according to an eighth embodiment of the present invention, and FIG. 10(*b*) is a schematic side diagram illustrating the inkjet head wiping device.

FIG. 10(*a*) is a schematic front diagram illustrating an inkjet head wiping device according to an eighth embodiment of the present invention, and FIG. 10(*b*) is a schematic side diagram illustrating the inkjet head wiping device. Note that in the description of the inkjet head wiping device according to the eighth embodiment with reference to FIGS. 10(*a*) and 10(*b*), components of the eighth embodiment which are common to those of the fifth embodiment are denoted by the same reference symbols, and detailed description thereof is omitted.

As illustrated in FIGS. 10(*a*) and 10(*b*), the inkjet head wiping device also has a structure in which the cleaning mobile unit 4 moves in the lateral direction indicated by the arrow Y. To move the cleaning mobile unit 4 in the lateral direction, the dimension of the cleaning mobile unit 4 in the longitudinal direction is set to be substantially equal to or a little longer than the dimension of the inkjet head 1 in the longitudinal direction. The suction port 7 of the vacuum nozzle 5 provided to the cleaning mobile unit 4 is formed into a slit shape which has a short length side in the lateral direction, and has a long length side in the longitudinal direction which is substantially equal to or a little longer than the length of an arrangement area for all the liquid material injection ports 3 of the inkjet head 1. Note that the suction port 7 has no obstructing portion formed therein.

Further, the cleaning mobile unit 4 includes not only the vacuum nozzle 5 but also the gas injection nozzle 9 for injecting and supplying a gas such as air or nitrogen to the one end surface 2 of the inkjet head 1. An area for injecting the gas by the gas injection nozzle 9 on the one end surface 2 of the inkjet head 1 substantially corresponds to an area for suction by the vacuum nozzle 5. Specifically, the gas injection area contains the entirety of the suction area. The gas injection ports 10 of the gas injection nozzle 9 are each formed into a slit shape which is short in the longitudinal direction and long in the lateral direction, and the two gas injection ports 10 are formed on both sides in the lateral direction with the single suction port 7 being as a center. Note that the suction port 7 of the vacuum nozzle 5 also has no obstructing portion formed therein.

As regards a specific structure of the cleaning mobile unit 4 according to the eighth embodiment, the side diagram thereof illustrated in FIG. 10(*b*) is identical with that as described above regarding the case where the "longitudinal direction" and the "lateral direction" of FIG. 8(*a*) are replaced with each other. In addition, the front diagram thereof illustrated in FIG. 10(*a*) is identical with that as described above (except the description of obstructing portion 8) regarding the case where the "longitudinal direction" and the "lateral direction" of the side diagram illustrated in FIG. 8(*a*) are replaced with each other.

In the structure according to the eighth embodiment, the foreign matters such as a solidified material of the film material and dust, which are attached to the one end surface 2 of the inkjet head 1, that is, the liquid material ejection port 3 and the vicinity thereof are further removed by the gas injected from the gas injection nozzle 9 of the cleaning mobile unit 4. At the same time, the foreign matters and the like are sucked into the vacuum nozzle 5 by the negative pressure acting from the vacuum nozzle 5. Then, the cleaning mobile unit 4 moves in the lateral direction indicated by the arrow Y while performing the above-mentioned operation, thereby cleaning the whole area or substantially the whole area of the one end surface (nozzle surface) 2 of the inkjet head 1.

In this case, during the time when the cleaning mobile unit 4 is moving in the lateral direction indicated by the arrow Y, at the time point when the suction port 7 of the vacuum nozzle 5 and each of the liquid material ejection ports 3 of the inkjet head 1 are opposed to each other, the suction by the vacuum nozzle 5 and the injection by the gas injection nozzle 9 are temporarily stopped. This is advantageous not only to the vacuum nozzle 5 as described above, but also to the gas injection nozzle 9, in that when the gas is stopped being injected and supplied directly from the gas injection port 10 with respect to each of the liquid material ejection ports 3, it is possible to avoid the adverse effect of the gas, which is injected and supplied from the gas injection ports 10, on the internal pressure of the liquid material provided in the inkjet head, through each of the liquid material ejection ports 3, or to avoid scattering of the liquid material. Note that when the suction force obtained by the vacuum nozzle 5 is set to low enough that the internal pressure of the liquid material provided in the inkjet head is not affected, through each of the liquid material ejection ports 3, it is unnecessary to temporarily stop the suction by the vacuum nozzle 5. The other operations and effects are the same as those of the sixth embodiment.

Ninth Embodiment

Figure 11:
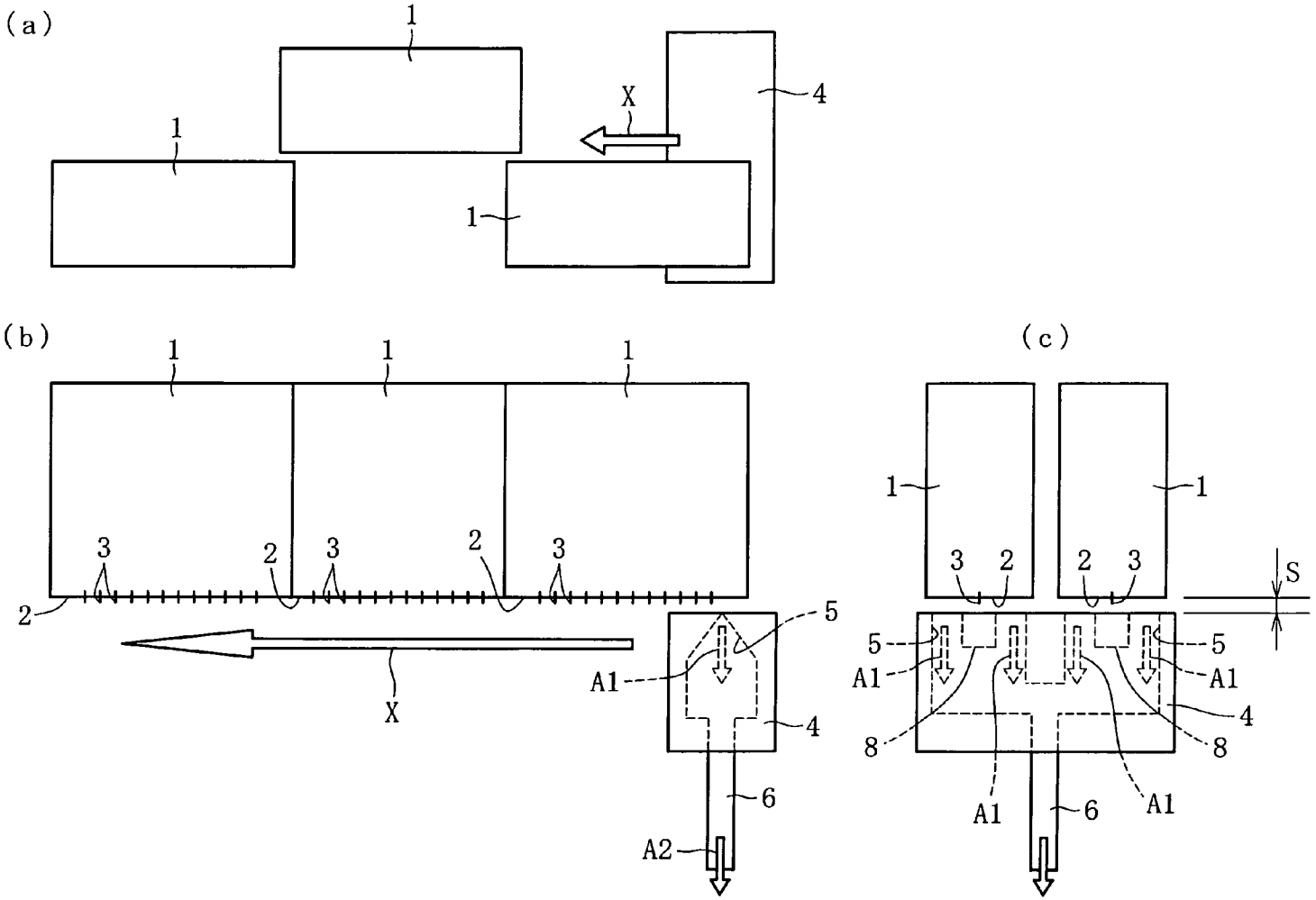
FIG. 11(*a*) is a schematic plan diagram illustrating an inkjet head wiping device according to a ninth embodiment of the present invention, FIG. 11(*b*) is a schematic front diagram illustrating the inkjet head wiping device, and FIG. 11(*c*) is a schematic side diagram of the inkjet head wiping device.
Figure 12:
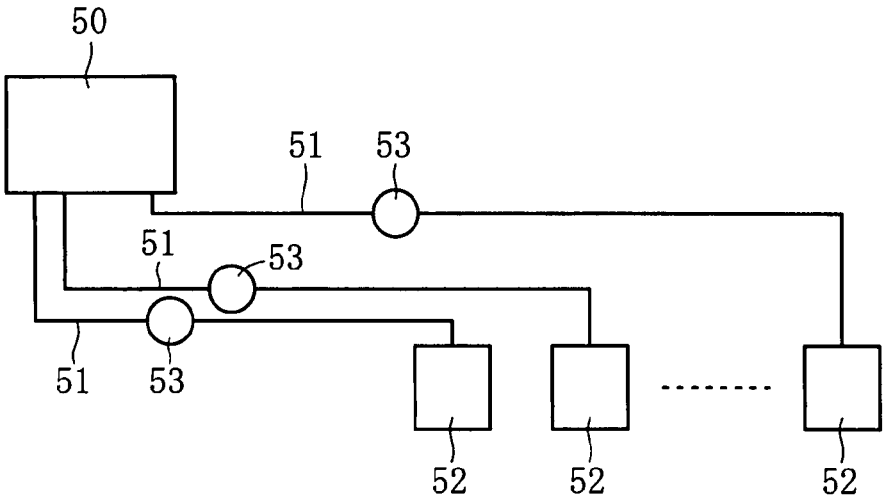
FIG. 12 is a schematic diagram illustrating a whole structure of a liquid feeding device for inkjet heads according to a related art.
Figure 13:
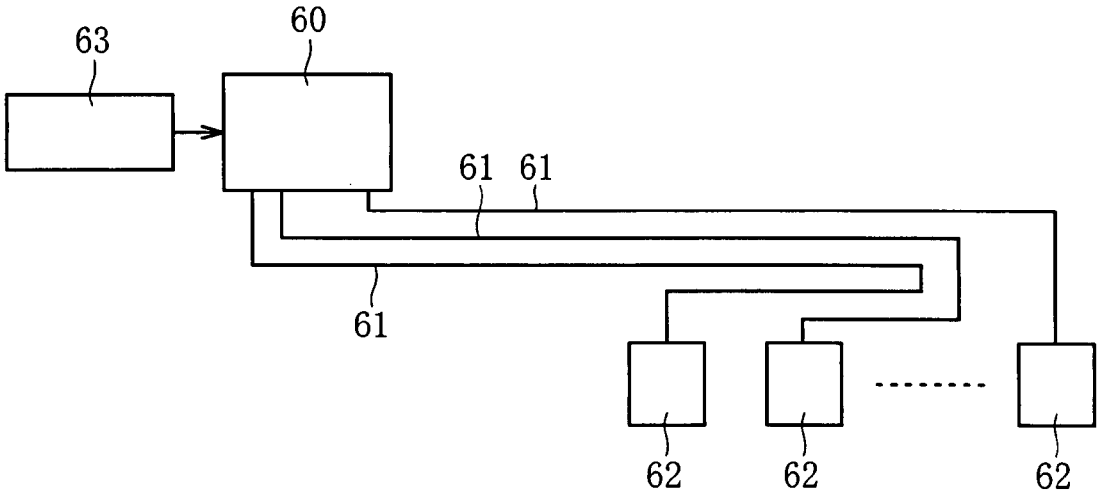
FIG. 13 is a schematic diagram illustrating a whole structure of a liquid feeding device for inkjet heads according to a related art.

FIG. 11(*a*) is a schematic plan view illustrating an inkjet head wiping device according to a ninth embodiment of the present invention, FIG. 11(*b*) is a schematic front diagram illustrating the inkjet head wiping device, and FIG. 11(*c*) is a schematic side diagram of the inkjet head wiping device. The ninth embodiment relates to a large printer or a large oriented film forming device in which a plurality of inkjet heads 1 are arranged in the longitudinal direction in a staggered manner. Note that in the description of the inkjet head wiping device according to the ninth embodiment with reference to FIGS. 11(*a*) to 11(*c*), components of the ninth embodiment which are common to those of the fifth embodiment are denoted by the same reference symbols, and detailed description thereof is omitted.

As illustrated in FIG. 11(*b*), the inkjet head wiping device includes the cleaning mobile unit 4 which is movable in the longitudinal direction as indicated by the arrow X. The structure of each of vacuum nozzles 5 provided to the cleaning mobile unit 4 is identical with that as described with reference to the front diagram of FIG. 7(*a*), when viewed from the front side. In the ninth embodiment, as illustrated in FIGS. 11(*a*) and 11(*c*), the cleaning mobile unit 4 is disposed so as to be laid across the length of two inkjet heads 1, and the cleaning mobile unit 4 has two vacuum nozzles 5 which are provided in parallel with each other along the inkjet heads 1 arranged in two rows. In this case, the two vacuum nozzles 5 are merged into one suction path 6 to communicate with a negative pressure source not shown in the figure. The structure of the suction port 7 of each of the vacuum nozzles 5, and the relative relationship between each of the suction ports 7 and each of the inkjet heads 1 for each row are the same as that of the fifth embodiment as described above.

In the structure according to the ninth embodiment, only by moving the single cleaning mobile unit 4 in the longitudinal direction indicated by the arrow X with respect to a plurality of inkjet heads 1 arranged in two rows, the cleaning operations using the negative pressure suction with respect to the one end surfaces 2 of all the inkjet heads 1 can be collectively performed. Note that in this case, due to the structure where portions at which the cleaning mobile unit 4 and the inkjet head 1 are not opposed to each other alternately appear, it is preferable that the suction by the two vacuum nozzles 5 be alternately stopped temporarily. The other actions and effects are the same as those of the fifth embodiment.

Note that in the ninth embodiment, there is employed a structure in which only two vacuum nozzles 5 are provided in parallel with each other to the cleaning mobile unit 4. Alternatively, by employment of the structure as illustrated in FIG. 8, each two sets of the vacuum nozzle 5 and the gas injection nozzle 9 may be provided in parallel with each other. With respect to each of the plurality of inkjet heads 1 which are arranged in two rows in a staggered manner, the cleaning mobile unit 4 as illustrated in FIG. 7 or FIG. 8 may be separately provided so as to perform cleaning.

INDUSTRIAL APPLICABILITY

The present invention can be effectively applied to an inkjet printer which is used not only in a case of performing printing on a base material made of paper, cloth, a resin, ceramic, or the like, but also in a case of forming an oriented film on a transparent glass substrate of a flat panel display such as a liquid crystal display device, or in a case of applying a color filter onto a transparent glass substrate of an organic EL display device, or the like. In particular, as regards the glass substrate for the liquid crystal display device, the present invention can be effectively applied to the inkjet printer used in the case of ejecting and applying a transparent PI ink (transparent polyimide ink) or a transparent UV ink, which is a material for forming an oriented film, onto the glass substrate. As regards the glass substrate of the organic EL display device, the present invention can be effectively applied to the inkjet printer for ejecting and applying the transparent UV ink, which is a coating material, onto the glass substrate.

The invention claimed is:

1. An inkjet head wiping device for cleaning a liquid material ejection port of an inkjet head and/or a vicinity thereof, the device comprising:

a cleaning mobile unit which includes a vacuum nozzle for generating a suction force by negative pressure in the vicinity of the liquid material ejection port, the cleaning mobile unit being relatively movable with respect to the inkjet head, wherein the suction force of the vacuum nozzle does not directly act on the liquid material ejection port and does not adversely affect internal pressure of the liquid material inside the inkjet head through the liquid material ejection port, and wherein all components of the cleaning mobile unit are completely separated from the inkjet head to be maintained in a contactless manner.

2. An inkjet head wiping device, for an oriented film forming device, comprising the inkjet head wiping device according to claim 1 which is provided to an inkjet head for forming an oriented film on a substrate.

3. An inkjet head wiping device according to claim 1, wherein the vacuum nozzle includes an obstruction portion disposed at a position opposing the liquid material ejection port such that the suction force of the vacuum nozzle does not act on the liquid material ejection port.

4. An inkjet head wiping device according to claim 1, wherein the cleaning mobile unit is movable in a lateral direction with respect to the inkjet head and temporarily stops the suction force of the vacuum nozzle as the vacuum nozzle opposes the liquid material ejection port such that the suction force does not act on the liquid material ejection port.

5. An inkjet head wiping device for cleaning a liquid material ejection port of an inkjet head and/or a vicinity thereof, the device comprising:

a cleaning mobile unit which includes a vacuum nozzle for generating a suction force by negative pressure in the vicinity of the liquid material ejection port, and also includes a gas injection nozzle for injecting and supplying a gas to the vicinity of the liquid material ejection port, the cleaning mobile unit being relatively movable with respect to the inkjet head, wherein the suction force of the vacuum nozzle does not directly act on the liquid material ejection port and does not adversely affect internal pressure of the liquid material inside the inkjet head through the liquid material ejection port, and wherein all components of the cleaning mobile unit are completely separated from the inkjet head to be maintained in a contactless manner.

6. An inkjet head wiping device according to claim 5, wherein the gas injection port of the gas injection nozzle is disposed at a position deflected from a position facing the liquid material ejection port of the inkjet head.

7. An inkjet head wiping device, for an oriented film forming device, comprising the inkjet head wiping device according to claim 5 which is provided to an inkjet head for forming an oriented film on a substrate.

8. An inkjet head wiping device according to claim 5, wherein the vacuum nozzle includes an obstruction portion disposed at a position opposing the liquid material ejection port such that the suction force of the vacuum nozzle does not act on the liquid material ejection port.

9. An inkjet head wiping device according to claim 5, wherein the cleaning mobile unit is movable in a lateral direction with respect to the inkjet head and temporarily stops the suction force of the vacuum nozzle as the vacuum nozzle opposes the liquid material ejection port such that the suction force does not act on the liquid material ejection port.

* * * * *